US006826873B2

(12) United States Patent
Valencia

(10) Patent No.: US 6,826,873 B2
(45) Date of Patent: Dec. 7, 2004

(54) ASEISMIC SYSTEM

(76) Inventor: Hector Valencia, 482 W. San Ysidro Blvd., Suite 545, San Ysidro, CA (US) 92173

( * ) Notice: Subject to any disclaimer, the term of this patent is extended or adjusted under 35 U.S.C. 154(b) by 0 days.

(21) Appl. No.: 10/262,582

(22) Filed: Sep. 30, 2002

(65) Prior Publication Data

US 2003/0150172 A1 Aug. 14, 2003

Related U.S. Application Data

(63) Continuation-in-part of application No. 09/393,233, filed on Sep. 9, 1999, now Pat. No. 6,457,285.

(51) Int. Cl.[7] ..... E04B 1/98
(52) U.S. Cl. ..... 52/167.2; 52/167.4; 52/167.6
(58) Field of Search ..... 52/1, 167.7, 167.8, 52/167.9, 167.4; 248/562

(56) References Cited

U.S. PATENT DOCUMENTS 4,554,767 A * 11/1985 Ikonomou ..... 52/167.9
6,289,640 B1 * 9/2001 Ueda et al. ..... 52/167.9
6,457,285 B1 * 10/2002 Valencia ..... 52/167.2
2002/0109066 A1 * 8/2002 Baudendistel et al. ..... 248/562

FOREIGN PATENT DOCUMENTS

JP 2002-122183 * 4/2002

* cited by examiner

*Primary Examiner*—Jerry Redman
(74) *Attorney, Agent, or Firm*—Procopio, Cory, Hargreaves & Savitch LLP

(57) ABSTRACT

The Improved Aseismic System of the present invention isolates a structure from seismic forces, and wind forces and seismic forces combined. During an earthquake the structure will slide on seismic filters, while gas dampeners act as shock absorbers to absorb the tremors and keep the structure from impacting its foundation. Fluid flow control assemblies control the flow of incompressible fluid between the double-action ram assemblies and the gas dampeners. Seismic filters provide a frictionless base for the structure support pillars to isolate them from the foundation and any forces which would otherwise be transmitted from the foundation to the structure's support pillars.

11 Claims, 14 Drawing Sheets

ASEISMIC SYSTEM

RELATED APPLICATIONS

This is a continuation in part of patent application Ser. No. 09/393,233, filed Sep. 9, 1999, and issued Oct. 1, 2002, as U.S. Pat. No. 6,457,285.

FIELD OF THE INVENTION

The present invention relates generally to systems used to protect structures from damage caused by the addition of external forces. More specifically, the present invention pertains to aseismic foundations used to isolate structures from destructive forces caused by earthquakes and strong winds. The present invention is particularly, though not exclusively, useful as a means for isolating a structure from the forces caused by seismic activity and high winds.

BACKGROUND OF THE INVENTION

Each year many earthquakes occur around the world resulting in catastrophic loss of life and devastating property damage. In areas along active fault lines, it is important that structures be designed to resist the damage caused by earthquakes. With traditional construction methods, structures are rigidly attached to the earth's surface.

When an earthquake occurs, the vibration of the earth is transferred directly to a structure's foundation, which, in turn, transmits the vibration to the structure. This can result in enormous shear forces which may cause irreparable structural damage to the structure. Moreover, if a structure is subjected to high winds in conjunction with seismic forces, the catastrophic results may be even greater.

Consequently, numerous foundation systems designed to be "earthquake proof" have been invented. These "earthquake proof" foundation systems may be classified as antiseismic or aseismic. The antiseismic class involves foundations which are designed to withstand the great forces caused by earthquakes. These antiseismic systems are bigger and stronger than typical foundation systems and do not allow any motion of the structure relative to its foundation. These systems are not very effective in preventing damage to a structure because the destructive forces are still transmitted through the foundation to the structure.

The aseismic class involves foundations which are designed to isolate the structure from these destructive forces. Aseismic foundations are generally flexible and allow relative motion between the structure and the earth. During an earthquake, this relative motion keeps the structure from being subjected to the destructive forces normally associated with earthquakes.

One such invention, as disclosed in U.S. Pat. No. 5,181,356, which issued in 1993 to Sul for an invention entitled "Earthquake Resistant Building Support System" (the "'356 patent"), includes a pedestal which rests on a slab. In between the pedestal and the slab is an "O" ring or a sheet of metal to reduce the friction between the pedestal and the slab. The pedestal is fixed to the structure support and moves relative to the slab when the earth shifts back and forth during an earthquake.

The device of the '356 patent is limited with respect to the amount of horizontal motion that it will allow. Moreover, the "O" ring or the sheet of metal sandwiched between the pedestal and the slab does not appear to reduce friction sufficiently to allow any motion at all. On the other hand, if either configuration reduces friction enough to allow some motion, the "O" ring or the metal sheet would be subjected to excessive wear and tear and would be nearly impossible or difficult to replace.

Another such invention, as disclosed in U.S. Pat. No. 4,771,581, which issued in 1988 to Nill for an invention entitled "Fluid Support System For Building Structures" (the "'581 patent"), includes the use of a liquid support system for separating a structure from its foundation. The device of the '581 patent includes the use of elongated conduits filled with an incompressible liquid to absorb vertical movement of the foundation wall caused by expanding or contracting soils. This device does not appear to allow any horizontal motion usually associated with earthquakes. Moreover, the device of the '581 patent is unable to account for and provide relief from the forces caused by strong winds in conjunction with seismic activity.

A third aseismic foundation, as disclosed in U.S. Pat. No. 4,766,706, which issued in 1988 to Caspe for an invention entitled "Earthquake Protection System For Structures" (the "'706 patent"), includes the use of a layer of plates to allow relative motion between the structure and the foundation. One plate is fixed to the top of the foundation, one plate is fixed to the underside of the structure support, and a third plate is sandwiched between these two plates.

During an earthquake, the plates are intended to slide with respect to each other in the horizontal direction. The device of the '706 patent is very complex and would likely be very expensive to build and maintain. Moreover, the device of the '706 patent does not allow any pivotal motion at the structure support, which would account for the situation that occurs when the foundation is moved out of vertical by buckling earth.

Accordingly, it is the object of the present invention to provide an aseismic foundation which will isolate a structure from seismic forces by allowing relative motion between a structure support system and its foundation in the horizontal direction. It is another object of the present invention to provide an aseismic foundation that will allow the foundation to move pivotally with respect to a structure support pillar. It is another object of the present invention to provide an aseismic foundation which will prevent catastrophic damage to a structure when subjected to seismic activity. It is another object of the present invention to provide an aseismic foundation which will prevent catastrophic damage to a structure when subject to high winds in conjunction with seismic activity. It is another object of the present invention to provide an aseismic foundation which will be relatively easy to maintain. It is another object of the present invention to provide an aseismic foundation which will last the lifetime of the structure. It is yet another object of the present invention to provide an aseismic foundation which will be relatively easy to manufacture, relatively easy to install, and relatively cost effective.

SUMMARY OF THE PRESENT INVENTION

The Improved Aseismic System of the present invention includes five major components which may be included in the construction of nearly any new structure erected in a seismically active area. These five components will drastically reduce, if not eliminate, the transmission of the seismic forces to these structures.

The first major component of the Improved Aseismic System of the present invention is the double-action hydraulic ram assembly. The double-action hydraulic ram assemblies are arranged under the base of the structure in a pattern reflecting the perimeter of the structure. Thus, a structure with a square perimeter would have four double-action ram assemblies arranged in a square its base.

Each double-action hydraulic ram assembly includes a large cylindrical housing encasing a hydraulic ram with a vertical piston centered axially on the ram. On each side of the piston is a hydraulic ram fluid chamber filled with an incompressible fluid. During an earthquake, as the tremors cause the earth to shift back and forth, the structure will slide on the rams depending on the direction of the motion caused by the tremor.

As the structure slides, the incompressible fluid is forced out of the hydraulic ram fluid chamber on the trailing side of the structure and into the next major component of the Improved Aseismic System of the present invention, the gas dampener. The gas dampener counteracts the motion of the structure along the double-action hydraulic ram assembly and returns the structure to its original position. Each chamber of the double-action hydraulic ram assembly includes a separate gas dampener.

The Improved Aseismic System of the present invention includes eight gas dampeners. Each gas dampener has three concentric pistons in a single cylinder separated by gases having different pressures. The bottom surface of the first piston in the gas dampener contacts the incompressible fluid shared with the corresponding hydraulic ram fluid chamber. As the fluid is forced into the gas dampener, the first piston is forced upward.

In between the first piston and the second piston is a compressible gas. As the first piston is forced upward, it compresses the first gas until it reaches the same pressure as the second gas. When the first gas pressure equals the second gas pressure, the first and second pistons will be forced upward in unison compressing the third gas until it reaches a pressure equal to the pressure of the first gas and the second gas. When the third gas pressure equals the first and second gas pressure, the third piston will also be forced upwards in unison with the first and second pistons.

Above the third piston is a static chamber with a gas valve that allows the third gas to pass into the static chamber. The top of the third piston is equipped with a spring loaded stem that is aligned with the gas valve in the static chamber. As the top of the third piston approaches the static gas chamber, the spring loaded stem engages the gas valve, closes the gas valve, and ceases the flow of gas into the static gas chamber.

With the gas valve closed, the third gas pressure will increase rapidly as the fluid continues to be forced into the gas dampener by the double-action hydraulic ram assembly. The rapid increase in gas pressure will counteract the effects of increased motion along the double-action piston and will prevent the structure from crashing into the end the ram or the foundation.

The third major component is the flow control assembly. The Improved Aseismic System of the present invention includes eight flow control assemblies. A flow control assembly is installed between each hydraulic ram fluid chamber and its corresponding gas dampener. The flow control assembly regulates the flow of the incompressible fluid between the hydraulic ram fluid chamber and corresponding gas dampener.

As the structure with the Improved Aseismic System is subjected to a load due to an earthquake, the flow control assembly allows the incompressible fluid to flow freely between the hydraulic ram fluid chamber and the gas dampener. However, when the structure is subjected to wind forces in addition to an earthquake load, the fluid flow control assembly responds appropriately depending on the direction of the wind in relation to the motion caused by the tremors.

The fourth major component of the Improved Aseismic System of the present invention is the pressure generator. The pressure generator includes a sail attached to a large arm which is balanced by a counter weight. The arm includes a centrally located ball which fits into a socket to allow the sail and arm to spin three hundred and sixty degrees (360° ) and bob up and down under the power of the wind. Attached to the arm is a plunger actuator connected to one or more plungers installed in corresponding cylinders which are, in turn, connected to corresponding fluid flow control assemblies via a pipe containing incompressible fluid.

As the plunger actuator moves, it causes a change in pressure in the incompressible fluid contained in the pipes between the cylinders and the flow control assemblies. An initial change in pressure will close a valve in the flow control assembly and block the flow of fluid between the hydraulic ram fluid chamber and the gas dampener. Any further pressure change will result in the injection of more incompressible fluid into the lower fluid chamber within the flow control assembly.

The fifth, and final, major component of the Improved Aseismic System of the present invention is the seismic filter. The seismic filter consists of a fluid confined between two plates. One plate is affixed to the bottom of a structure support pillar and the other plate is affixed to the foundation. The confined fluid keeps the two plates from contacting each other and allows for relative motion between the plates. The foundation plate further includes a convex surface and a concave surface separated from each other by a lubricant. This configuration allows for slight pivotal motion at the base of the structure if the foundation is shaken out of level during an earthquake.

The invention as described above overcomes many of the disadvantages of the previous aseismic foundation systems. The present invention provides an aseismic foundation system that allows relative motion between a structure support system and foundation in any horizontal direction. The present invention also prevents catastrophic damage to a structure when subjected to seismic forces. Moreover, the present invention prevents catastrophic damage to a structure which is subject to high winds in conjunction to seismic forces. Finally, the present invention is relatively easy to install, and relatively easy to maintain.

DESCRIPTION OF THE DRAWINGS

The novel features of this invention, as well as the invention itself, both as to its structure and its operation, will be best understood from the accompanying drawings, taken in conjunction with the accompanying description, in which reference characters refer to similar parts, and in which.

DETAILED DESCRIPTION

Figure 1:
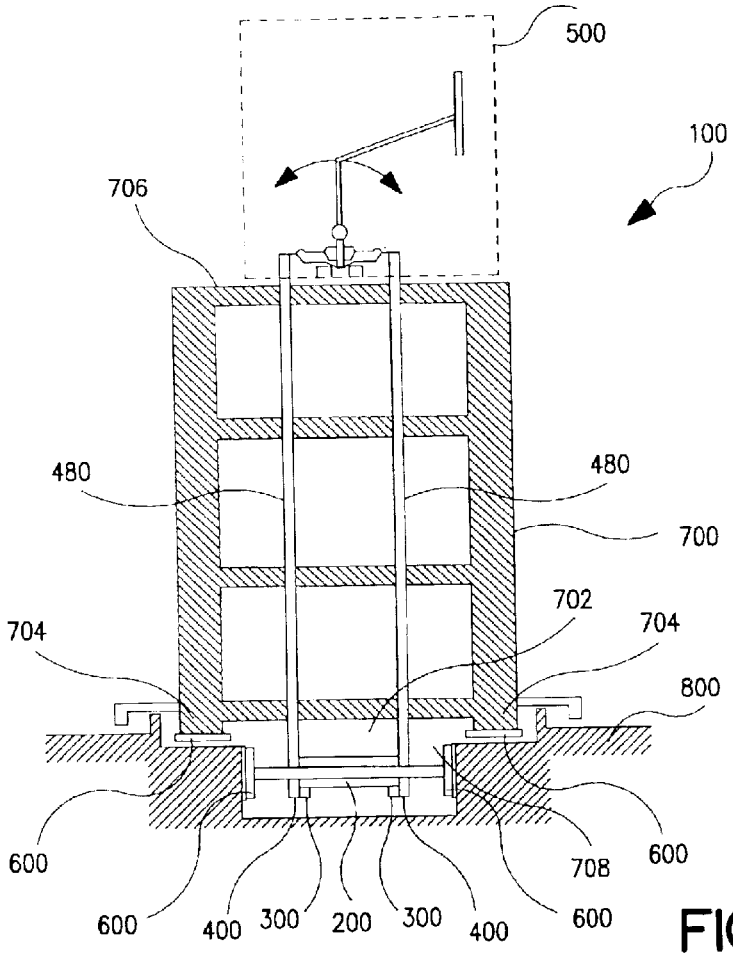
FIG. 1 is a front plan view of a structure showing the installation of the Improved Aseismic System of the present invention.

Referring initially to FIG. 1 the Improved Aseismic System of the present invention is shown and generally designated 100. FIG. 1 shows the major components of Improved Aseismic System 100 installed in a structure 700. The structure 700 includes a base 702, a plurality of support pillars 704, a roof 706 and a basement 708. Installed in the basement 708 of the structure 700 are the double-action hydraulic ram assemblies, generally designated 200.

The structure 700 in this instance is a multi-story building with a square perimeter. It can be appreciated that the structure 700 could be a house, a bridge, or any other similar structure.

The double-action hydraulic ram assemblies 200 are rigidly attached to the base 702 of the structure 700, but are isolated from the foundation 800 by the seismic filters 600. One seismic filter 600 may be affixed vertically to each end of the double-action hydraulic ram assemblies 200. Additionally, a seismic filter 600 may be mounted horizontally under each support pillar 704. These seismic filters 600 isolate the support pillars 704 from the foundation 800. It is to be appreciated that the structure 700 is not rigidly linked to the foundation 800.

Mounted on roof 706 of the structure 700 is the wind-sensitive pressure generator, generally designated 500. The wind-sensitive pressure generator 500 actuates the flow control assembly 400. The wind-sensitive pressure generator 500 and the flow control assembly 400 interact through the use of an incompressible fluid 210 which is contained in a sealed pipe 480 connected to the wind-sensitive pressure generator 500 and the flow control assembly 400. FIG. 1 shows the sealed pipe 480 installed in the structure 700 from the roof 706 to the basement 708.

Figure 2:
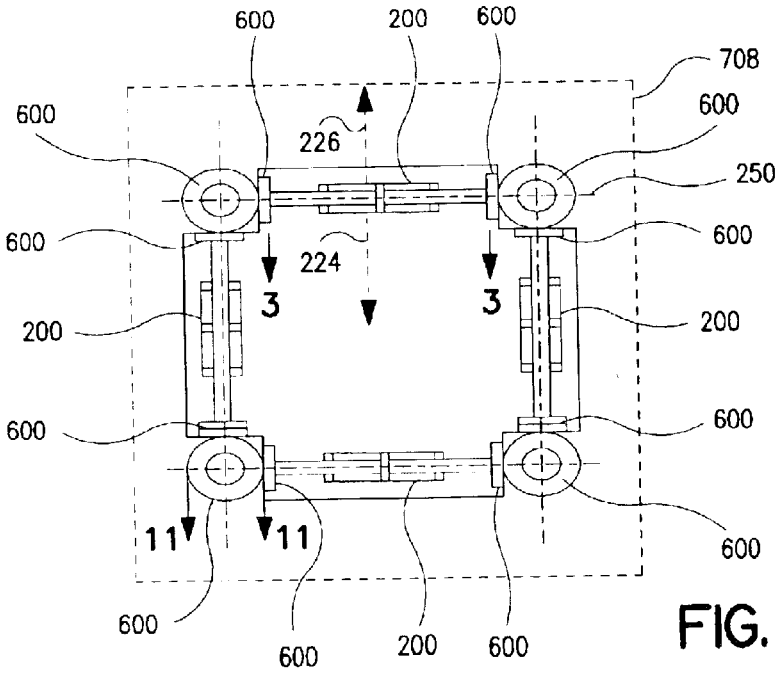
FIG. 2 is a top plan view of a basement of a structure showing the installation of the double-action hydraulic pistons of the Improved Aseismic System of the present invention.

FIG. 2 shows the configuration of the double-action hydraulic ram assemblies 200 in the basement 708 of the structure 700. The double-action hydraulic ram assemblies 200 are arranged under the base 702 of the structure 700 in a pattern reflecting the perimeter of the structure 700.

In this embodiment of the Improved Aseismic System 100, the structure 700 has a square perimeter and thus, includes four double-action hydraulic ram assemblies 200 arranged in a square under the base 702 of the structure 700. It can be appreciated that if the structure 700 had a triangular perimeter it would include three double-action hydraulic ram assemblies 200 arranged in a triangle under the base 702 of the structure 700.

Figure 3:
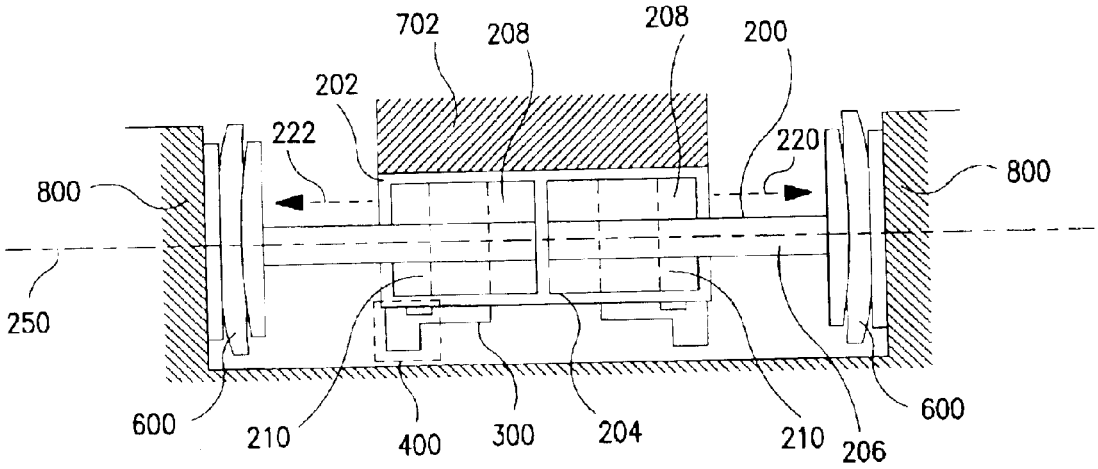
FIG. 3 is a cross-section of the double-action hydraulic piston of the Improved Aseismic System of the present invention along section line 3—3 in FIG. 2.

FIG. 3 shows a single double-action hydraulic ram assembly 200 in greater detail. The double-action hydraulic ram 200 includes a cylindrical ram housing 202 rigidly attached to the base 702 of the structure 700. Within the cylindrical ram housing 202 is a vertical piston 204 rigidly attached to the center of a ram 206. On each side of the vertical piston 204 is a hydraulic ram fluid chamber 208 filled with an incompressible fluid 210.

The ram 206 is placed between two solid walls of the foundation 800 and is stationary along axis 250. The cylindrical ram housing 202 is free to move along the ram 206 in directions 220 and 222. Consequently, the structure 700 is free to move with respect to the ram 206 along axis 250 in directions 220 and 222.

It is to be appreciated that the ram 206 does not move in directions 220 and 222. The ram 206 is held stationary between the two solid walls of the foundation 800 along axis 250 by the seismic filters 600 attached at each end of the ram 206. The seismic filters 600, however, may allow motion of the entire double-action hydraulic ram assembly 200 perpendicular to axis 250. Referring now to FIG. 2, it is shown that the entire double-action hydraulic ram assembly 200 may be free to move in directions 224 and 226, perpendicular to axis 250.

Referring back to FIG. 3, as the structure 700 moves with respect to the ram 206, in either direction 220 or direction 222, the incompressible fluid 210 contained in the hydraulic ram fluid chamber 208 opposite the direction of motion may be forced out of the hydraulic ram fluid chamber 208 and into a corresponding gas dampener fluid chamber 370. Each hydraulic ram fluid chamber 208 has a separate gas dampener 300 and the incompressible fluid 210 may not flow between the individual fluid chambers 208.

Figure 4:
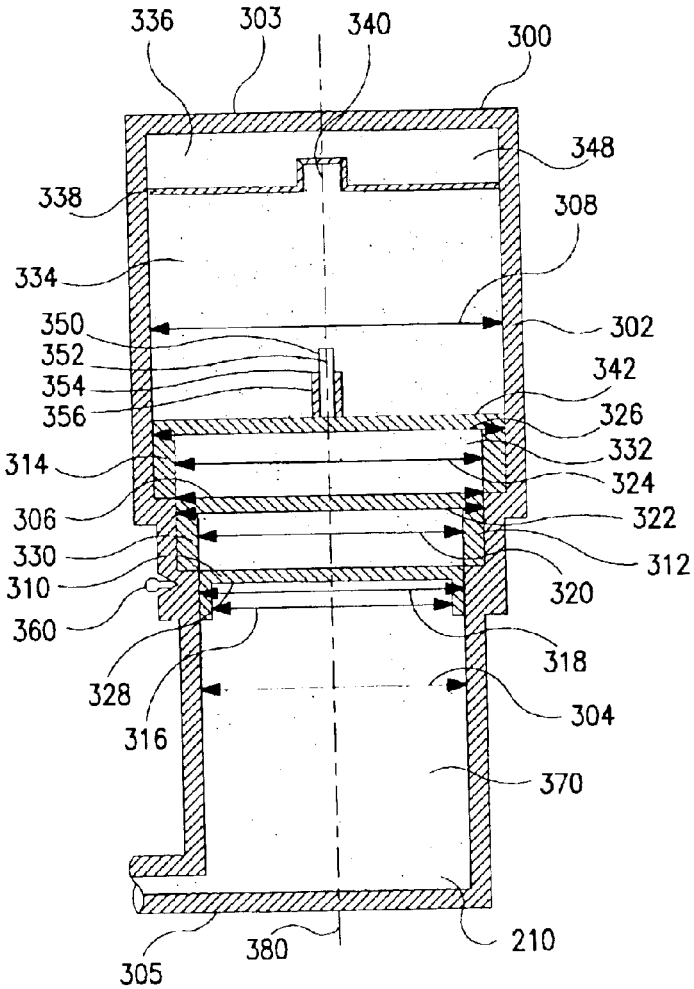
FIG. 4 is a cross-section view of the gas dampener of the Improved Aseismic System of the present invention which is partially shown in FIG. 3 and demarcated by dashed box 300.

Referring now to FIG. 4, the gas dampener 300 is shown. Each gas dampener 300 consists of a cylindrical dampener housing 302 having a top 303, a bottom 305, a first internal diameter 304, a second internal diameter 306, and a third internal diameter 308. Within the gas dampener 300 is a first piston 310, a second piston 312 and a third piston 314. The gas dampener 300 also includes an air valve 360 through the cylindrical dampener housing 302 located between the first piston 310 and the second piston 312.

The first piston 310 has an internal diameter 316, an external diameter 318 and a lower surface 328. The second piston 312 has an internal diameter 320 and an external diameter 322. The third piston 314 has an internal diameter 324, an external diameter 326, and an upper surface 342

FIG. 4 shows that the external diameter 318 of the first piston 310 may be slightly smaller than the internal diameter 320 of the second piston 312 to allow the first piston 310 to slide into the second piston 312. The external diameter 322 of the second piston 312 may be slightly smaller than the internal diameter 324 of the third piston 314 to allow the second piston 312 to slide into the third piston 314.

FIG. 4 also shows first piston 310 separated from the second piston 312 by the first gas 330 and the second piston 312 separated from the third piston 314 by the second gas 332. In between the third piston 314 and the top of the cylindrical dampener housing 302 is a static divider 338. The third piston 314 and the static divider 338 are separated by a third gas 334.

The chamber 348 created by the static divider 338 and the top 303 of the cylindrical dampener housing 302 is filled with a fourth gas 336. The static divider 338 includes a gas valve 340 which is normally open and allows the third gas 334 to co-mingle with the fourth gas 336. The upper surface 342 of the third piston 314 is equipped with a spring-loaded stem assembly 350 that will engage the gas valve 340 and close it. The spring-loaded stem assembly 350 consists of a stem 352 mounted on a spring 354 and fitted into a slider 356.

It is to be appreciated that when the gas dampener 300 is in the at rest position, the pressures of the fourth gas 336 and the third gas 334 are equal. This pressure is greater than that of the second gas 332 which, in turn, is greater than the pressure of the first gas 330.

FIG. 4 further shows the lower surface 328 of the first piston 310 in contact with the incompressible fluid 210 within the gas dampener fluid chamber 370. As the incompressible fluid 210 is forced out of the hydraulic ram fluid chamber 208 and into the gas dampener fluid chamber 370, the first piston 310 will be forced upward along axis 380.

The upward motion of the first piston 310 will compress the first gas 330 until the pressure in the first gas 330 is equal to the pressure of the second gas 332. When the pressure of the first gas 330 is equal to pressure of the second gas 332, the first piston 310 and the second piston 312 will move upward, in unison, along axis 380.

The upward motion of the first piston 310 and the second piston 312 will continue to compress the first gas 330 and begin compressing the second gas 332 at the same pressure as the first gas 330. As the incompressible fluid 210 continues to be forced into the gas dampener 300, the pressures of the first gas 330 and the second gas 332 will continue to increase until they reach the pressure of the third gas 334.

Once the pressures of the first gas 330 and the second gas 332 equal the pressure of the third gas 334, the third piston 314 will then travel upward along axis 380, in unison with the first piston 310 and the second piston 312. This motion will continue to compress the first gas 330 and the second gas 332 and begin compressing the third gas 334 and the fourth gas 336 at the same rate.

As more incompressible fluid 210 is forced into the gas dampener fluid chamber 370, the pressure in the first gas 330, the second gas 332, the third gas 334 and the fourth gas 336 may gradually increase. This gradual increase will continue until the spring loaded stem assembly 350, mounted on the upper surface 342 of the third piston 314, engages the gas valve 340, closes the gas valve 340, and keeps the third gas 334 from interacting with the fourth gas 336.

Closing the gas valve 340 significantly decreases the volume that the third gas 334 occupies, and, as such, the pressure in gases 330, 332 and 334 may rapidly rise with the continued influx of the incompressible fluid 210. The pressure in the fourth gas 336 will remain constant once the gas valve 340 is closed.

The air valve 360 allows air to enter the gas dampener 300 between the first piston 310 and the second piston 312, which will prevent a vacuum from forming, between the first piston 310 and the second piston 312, when the incompressible fluid 210 is drawn out of the gas dampener 300 and into the corresponding hydraulic ram fluid chamber 208.

Figure 5:
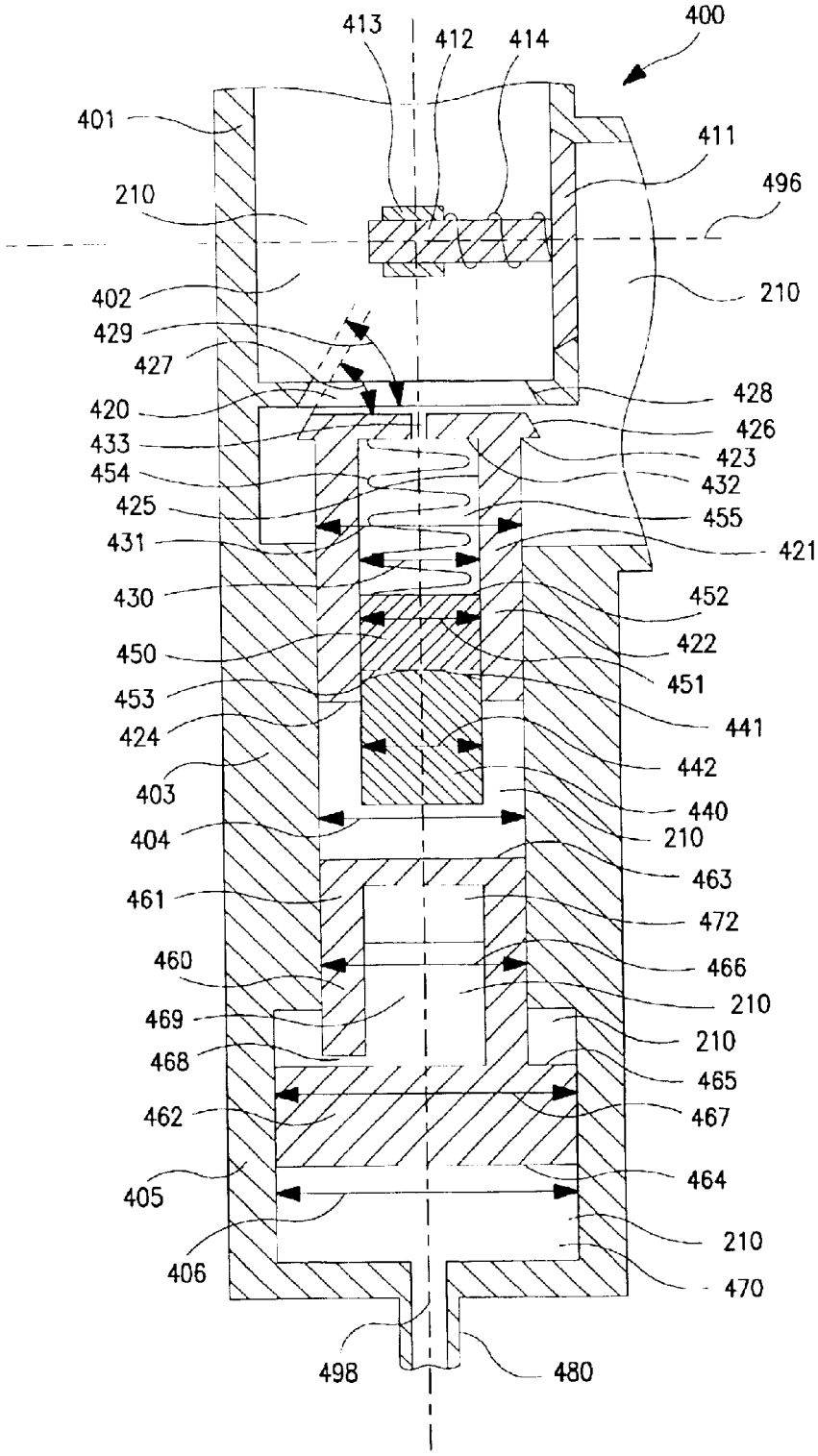
FIG. 5 is a detailed cross section view of the flow control assembly of the Improved Aseismic System of the present invention, shown in the normal position and demarcated by dashed box 400 in FIG. 3.

As the incompressible fluid 210 is forced out of the double-action hydraulic ram assembly 200 and into the gas dampener 300, it will move through the flow control assembly 400. FIGS. 5 through 8 show the flow control assembly 400 in the various positions that it may encounter. FIG. 5 shows the flow control assembly 400 in the normally open position without any forces acting on the structure 700.

Figure 6:
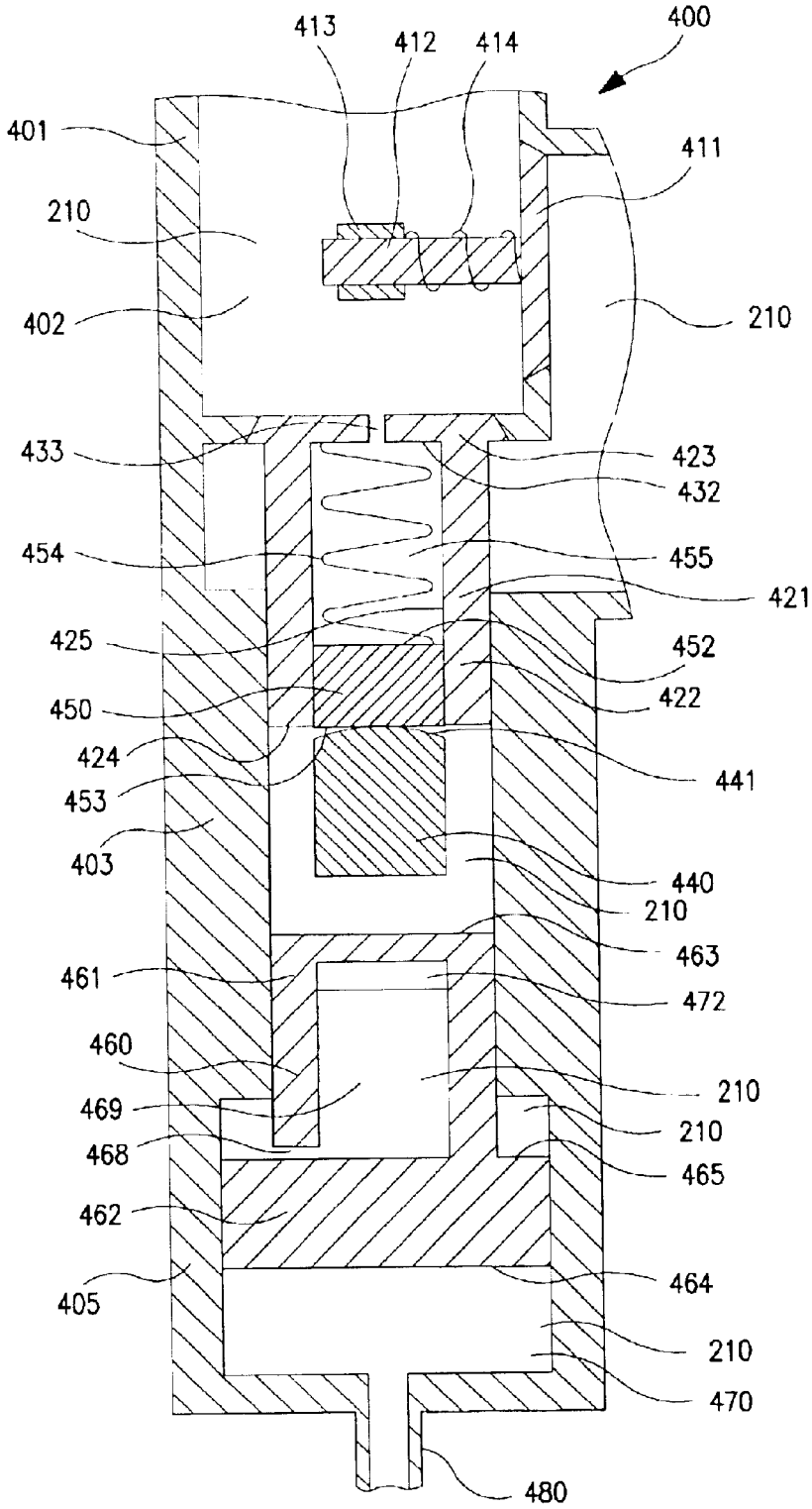
FIG. 6 is a detailed cross section view of the flow control assembly of the Improved Aseismic System of the present invention in the wind countering position when the structure is subjected to a transverse load due to strong winds.
Figure 7:
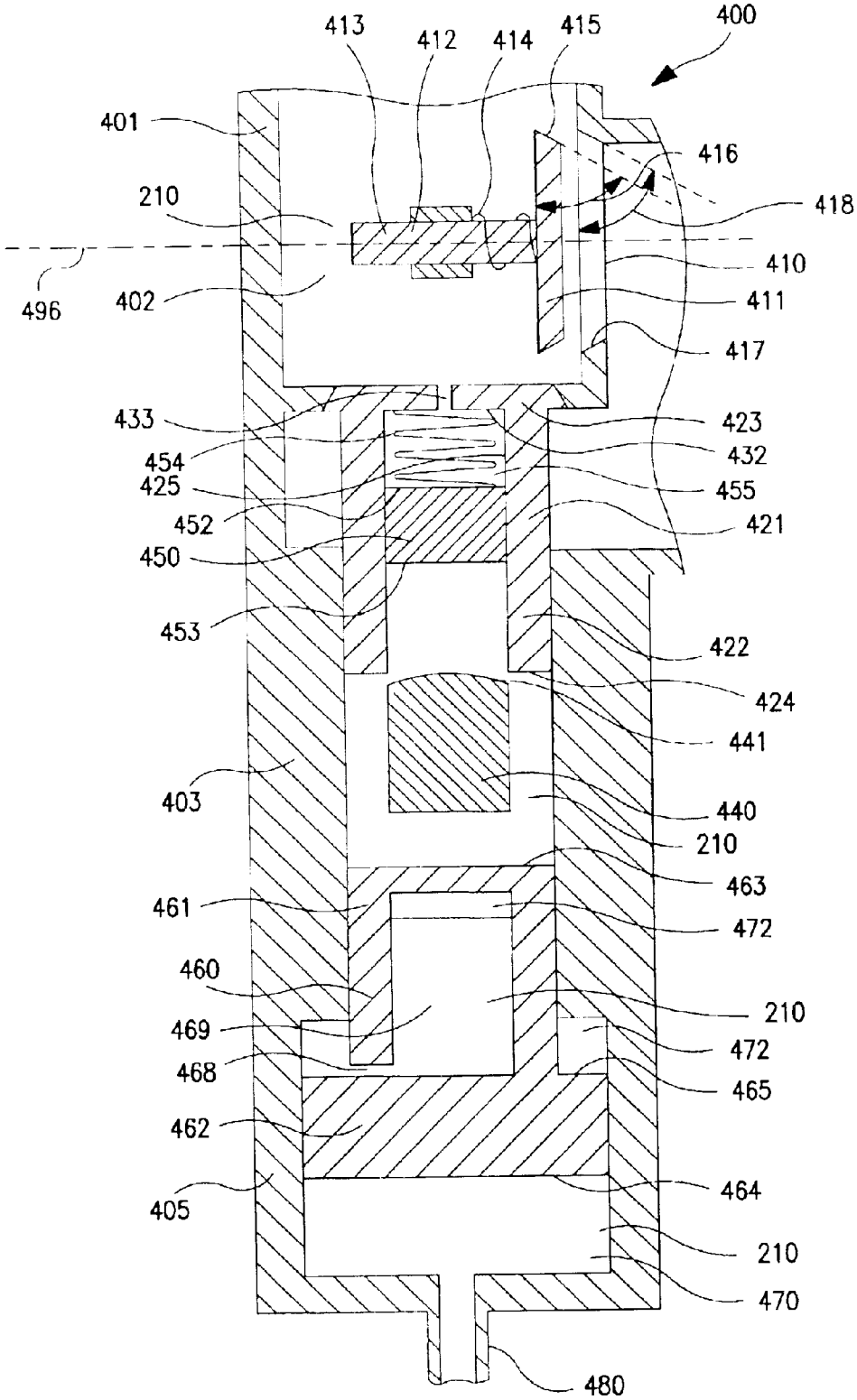
FIG. 7 is a detailed cross section view of the flow control assembly of the Improved Aseismic System of the present invention in the combined wind-tremor position when the structure is subjected to a transverse load due to an earthquake and strong winds acting in the same direction.
Figure 8:
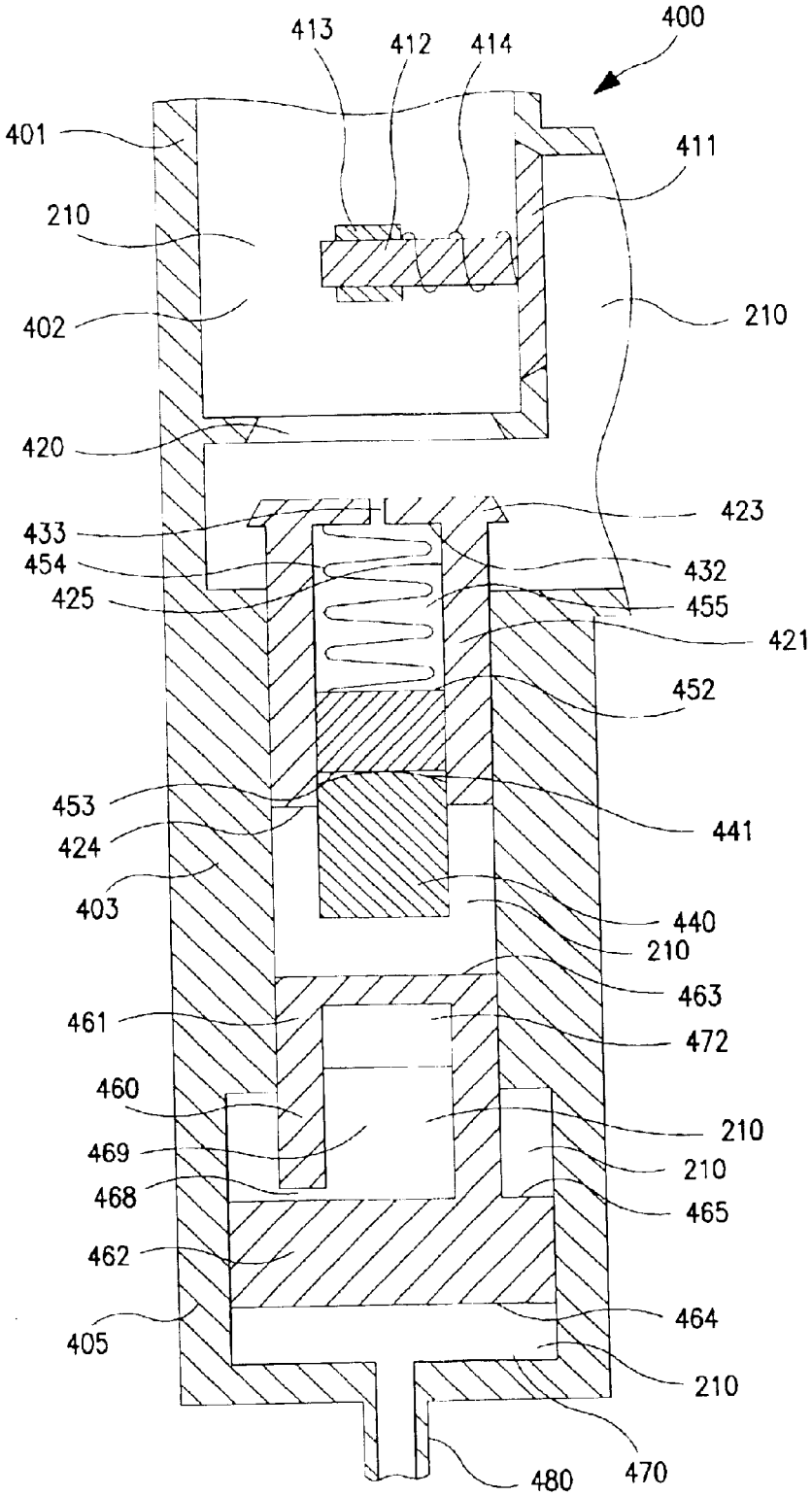
FIG. 8 is a detailed cross-section view of the flow control assembly of the Improved Aseismic System of the present invention in the counteractive wind-tremor position when the structure is subjected to a transverse load due to an earthquake and strong winds acting in opposite directions.

FIG. 6 shows the flow control assembly 400 in the wind countering position. FIG. 7 shows the flow control assembly 400 in the combined wind-tremor position caused by earthquake forces and wind forces acting in the same direction. FIG. 8 shows the flow control assembly 400 in the combined wind-tremor position caused by earthquake forces and wind forces acting in opposite directions.

Referring to FIGS. 5 through 8, the flow control assembly 400 includes a flow control housing 401 which contains all the parts of the flow control assembly 400. The flow control housing 401 includes an upper fluid chamber 402, a central cylindrical portion 403 with an internal diameter 404, and a lower cylindrical portion 405 with an internal diameter 406.

The flow of incompressible fluid 210 between the double-action hydraulic ram assembly 200 and the gas dampener 300 occurs through the upper fluid chamber 402 of the flow control assembly 400. FIGS. 5 through 8 show an upper orifice 410 which, when open, may allow the incompressible fluid 210 to flow between the double-action hydraulic ram assembly 200 and the gas dampener 300. FIGS. 5 through 8 also show a lower orifice 420, which may also allow the incompressible fluid 210 to flow between the hydraulic ram fluid chamber 208 and its corresponding gas dampener 300.

An upper valve 411 sized to fit into and seal the upper orifice 410 is shown and includes an upper valve stem 412 fitted into an upper valve guide 413 aligned perpendicularly with the upper orifice 410 along axis 496. Around the upper valve stem 412 is an upper valve spring 414 which holds the upper valve 411 in the normally closed position. The upper valve 411 also includes a perimeter surface 415 which is beveled at angle 416, as shown in FIG. 7.

FIG. 7 shows that the upper orifice 410 also includes an interior surface 417 beveled at an angle 418. The angle 416 is the same as the angle 418 to allow the upper valve 411 to fit tightly into the upper orifice 410 and block the flow of the incompressible fluid 210 between the hydraulic ram fluid chamber 208 and the gas dampener 300. In a preferred embodiment, the angles 416 and 418 are approximately forty-five degrees (45°). It can be appreciated, however, that these angles 416 and 418 may be in a range from five degrees (5°) to eighty-five degrees (85°).

FIGS. 5 through 8 show a lower valve 421 sized to seal the lower orifice 420. The lower valve 421 has a hollow cylindrical base 422, a valve cap 423, a lower pressure surface 424 and an interior surface 425. FIG. 5 shows the valve cap 423 with a perimeter surface 426 beveled at an angle 427 and a lower surface 432. The lower orifice 420 has an interior surface 428 beveled at an angle 429.

The angle 429 may be equal to the angle 427 to allow the lower valve 421 to fit snugly into the horizontal circular orifice 420 and effectively block the flow of incompressible fluid 210 through it when the lower valve 421 is closed, as shown in FIGS. 6 and 7. In a preferred embodiment, the angles 427 and 429 are approximately forty-five degrees (45°). It can be appreciated, however, that these angles 427 and 429 may be in a range from five degrees (5°) to eighty-five degrees (85°).

The hollow cylindrical base 422 has an internal diameter 430 and an external diameter 431. The external diameter 430 of the hollow cylindrical base 422 may be slightly less than the internal diameter 404 of the central cylindrical portion 403 of the flow control housing 401. The hollow cylindrical base 422 fits into the central cylindrical portion 403 of the flow control housing 401 and slides up and down along axis 498. The hollow cylindrical base 422 also fits over a stationary block 440 which has an upper beveled surface 441 and an external diameter 442 slightly smaller than the internal diameter 430 of the hollow cylindrical base 422.

In between the stationary block 440 and the lower surface 432 of the valve cap 423 is the upper piston 450 which has an external diameter 451 slightly smaller than the internal diameter 430 of the hollow cylindrical base 422, an upper surface 452 and a lower surface 453. The lower surface 453 of the upper piston 450 is held in contact with the upper beveled surface 441 of the stationary block 440 by a spring 454 located between the top surface 452 of the upper piston 450 and the lower surface 432 of the valve cap 423.

Located in the center of the valve cap 423 is a small vertical hole 433. The small vertical hole 433 allows a portion of the incompressible fluid 210 to flow into the interior fluid chamber 455 of the lower valve 421 created by the interior surface 425 of the hollow cylindrical base 422, the lower surface 432 of the valve cap 423, and the top surface 452 of the upper piston 450.

FIGS. 5 through 8 also show a lower piston 460 with a hollow cylindrical portion 461, a solid cylindrical portion 462, an upper surface 463, a lower surface 464, and an intermediate surface 465. The hollow cylindrical portion 461 has an external diameter 466 which may be slightly smaller than the internal diameter 404 of the central cylindrical portion 403 of the flow control housing 401 to allow the lower piston 460 to fit within the central cylindrical portion 403 of the flow control housing 401. The hollow cylindrical portion 461 of the lower piston 460 includes a small horizontal hole 468 which leads to an interior chamber 469 within the lower piston 460. The interior chamber 469 of the lower piston 460 is partially filled with a fifth gas 472.

The solid cylindrical portion 462 has an external diameter 467 which may be slightly smaller than the internal diameter 406 of the lower cylindrical portion 405 of the flow control housing 401. The hollow cylindrical portion 461 of the lower piston 460 fits into the central cylindrical portion 403 of the housing while the solid cylindrical portion 462 of the lower piston 460 fits into the lower cylindrical portion 405 of the housing. The lower piston 460 will slide up and down along axis 498.

FIGS. 5 through 8 show a lower fluid chamber 470 beneath the lower piston 460. As incompressible fluid 210 is injected into the lower fluid chamber 470, the lower piston 460 will be forced upward along axis 498. As the lower piston 460 moves upward, incompressible fluid 210 will be forced through the small horizontal hole 468 into the interior fluid chamber 469 of the lower piston 460 and compress the fifth gas 472. The fifth gas 472 acts a spring to return the lower piston 460 to its original piston when the wind subsides and incompressible fluid 210 is no longer injected into the lower fluid chamber.

FIGS. 5 through 8 also show incompressible fluid 210 confined between the bottom surface 424 of the lower valve 421 and the upper surface 463 of the lower piston 460. As the lower piston 460 is forced up by incompressible fluid 210, the lower valve 421 will be forced upward along axis 498 and the valve cap 423 will seal the lower orifice 420 as shown in FIG. 6.

It can be appreciated that the upper valve 411 is directional and only allows the incompressible fluid 210 to flow from the gas dampener 300 to the hydraulic ram fluid chamber 208. Moreover, the upper valve 411 is spring-loaded and normally held in the closed position, as shown in FIGS. 5, 6 and 8. The upper valve 411 will only open when the lower valve 421 is closed and the fluid pressure in the gas dampener 300 is greater than the fluid pressure in the hydraulic ram fluid chamber 208 of the double-action hydraulic ram assembly 200.

When the lower valve 421 is shifted into the closed position, as shown in FIGS. 6 and 7, the bottom surface 424 of the lower valve 421 will be above the beveled upper surface 441 of the stationary block 440. FIG. 6 shows that when the lower valve 421 initially closes, the incompressible fluid 210 may be in contact with the lower surface 453 of the upper piston 450. Any further injections of incompressible fluid 210 into the lower fluid chamber 470 may be transmitted directly to the upper piston 450 via the lower piston 460 and incompressible fluid 210. The upper piston 450 may move upward along axis 498 and force incompressible fluid 210 out of the interior fluid chamber 455 through the small vertical hole 433 in the valve cap 423.

Figure 9:
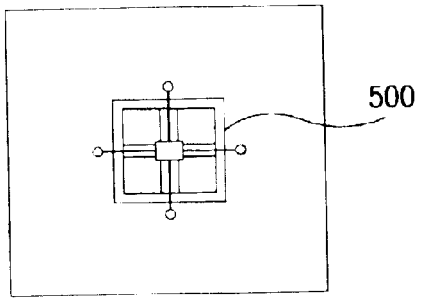
FIG. 9 is a top plan view of the generic roof showing the installation of the pressure generator of the Improved Aseismic System of the present invention.
Figure 10:
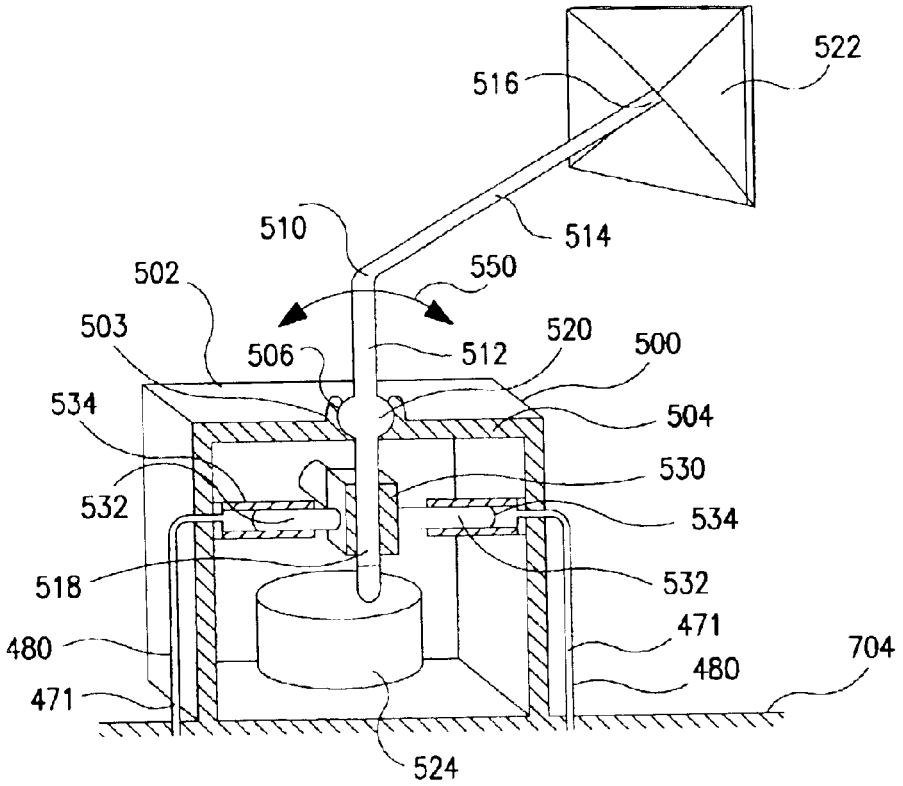
FIG. 10 is a perspective view of the pressure generator of the Improved Aseismic System of the present invention, demarcated by dashed box 500 in FIG. 1, with the pressure generator housing cut away to reveal the internal components.

FIG. 9 shows the wind-sensitive pressure generator assembly 500 mounted in the center of the roof 706 of the structure 700. FIG. 10 shows the wind-sensitive pressure generator assembly 500 in greater detail. FIG. 10 shows a pressure generator housing 502 which holds the working parts of the wind-sensitive pressure generator assembly 500.

The pressure generator housing 502 includes a top plate 504 with a spherical socket 506 formed near the center 503 of the top plate 504.

Inserted through this spherical socket 506 is an arm 510 having a vertical portion 512, an angled portion 514, an upper end 516 and a lower end 518. Located centrally along the vertical portion 512 of the arm is a ball 520 sized to fit into the spherical socket 506. In can be appreciated that this ball 520 and socket 506 configuration may allow the arm 510 to move in all directions with respect to the pressure generator housing 502.

FIG. 10 shows a sail 522 attached to the upper end 516 of the angled portion 514 of the arm 510. Attached to the lower end 518 of the vertical portion 512 of the arm 510 is a counterweight 524 to balance the sail 522 and keep the arm 510 in the upright position, as shown in FIG. 10, when not subjected to wind. As the sail 522 moves under the force of the wind, the arm 510 will rotate three-hundred and sixty degrees (360°) about the ball 520 and pivot back and forth along arc 550. Located between the counterweight 524 and the ball 520 is the plunger actuator 530.

On each side of the plunger actuator 530 is a hydraulic plunger 532. Each hydraulic plunger 532 fits into a cylinder 534 which is connected to a corresponding flow control assembly 400 via a sealed pipe 480. Each sealed pipe 480 and adjacent cylinder 534 is filled with an incompressible fluid 210. As the arm 510 is moved by the sail 522, the plunger actuator 530 will depress one of the hydraulic plungers 532 into its cylinder 534. The motion of the hydraulic plunger 532 will cause the incompressible fluid 210 to move within the sealed pipe and inject incompressible fluid 210 into the lower fluid chamber 470 of the flow control assembly 400 and close the lower valve 421 to block the flow of incompressible fluid 210 between the double-action hydraulic ram assembly 200 and its corresponding gas dampener 300.

Figure 10A:
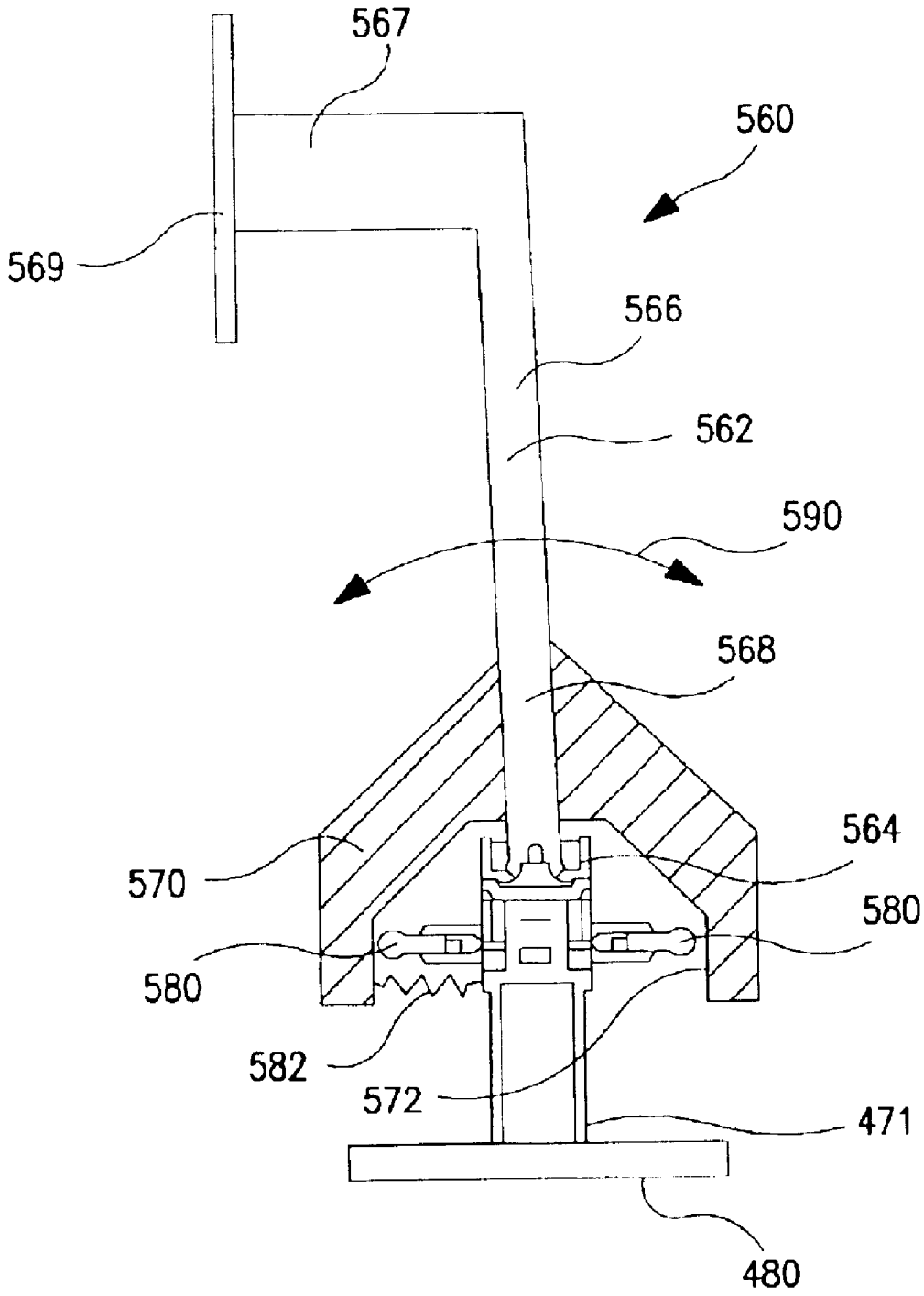
FIG. 10A is a side plan view of an alternative embodiment of the pressure generator of the Improved Aseismic System of the present invention shown in FIG. 10 with the hollow conical housing cut away to reveal the internal components.

FIG. 10A shows an alternative embodiment of the wind-sensitive pressure generator assembly generally designated 560. The wind-sensitive pressure generator assembly 560 includes an arm assembly 562 mounted on a ball and socket joint 564. The arm assembly 562 includes an arm 566 with an upper end 567 and a lower end 568. Attached to the upper end 567 of the arm 566 is a sail 569.

Attached to the lower end 568 of the arm 566 is a hollow conical housing 570 having an interior surface 572. Within the hollow conical housing 570 are the hydraulic plungers 580 and the balancing spring 582. As the sail 569 is moved by the wind, the arm assembly 562 rotates about the ball and socket joint 564 and pivots about the ball and socket joint 564 along arc 590. The motion by the arm assembly 562 causes the hollow conical housing 570 to move back and forth.

The interior surface 572 of the hollow conical housing 570 maintains contact with the hydraulic plungers 580, and as the hollow conical housing 570 moves, at least one of the hydraulic plungers 580 will be depressed and force the incompressible fluid 210 to move within the sealed pipe 480 and into a corresponding flow control assembly 400. The balancing spring 582 rotates with the arm assembly 562 about the ball and socket joint 564 and returns the arm assembly 562 to the upright position when the wind ceases.

Figure 11:
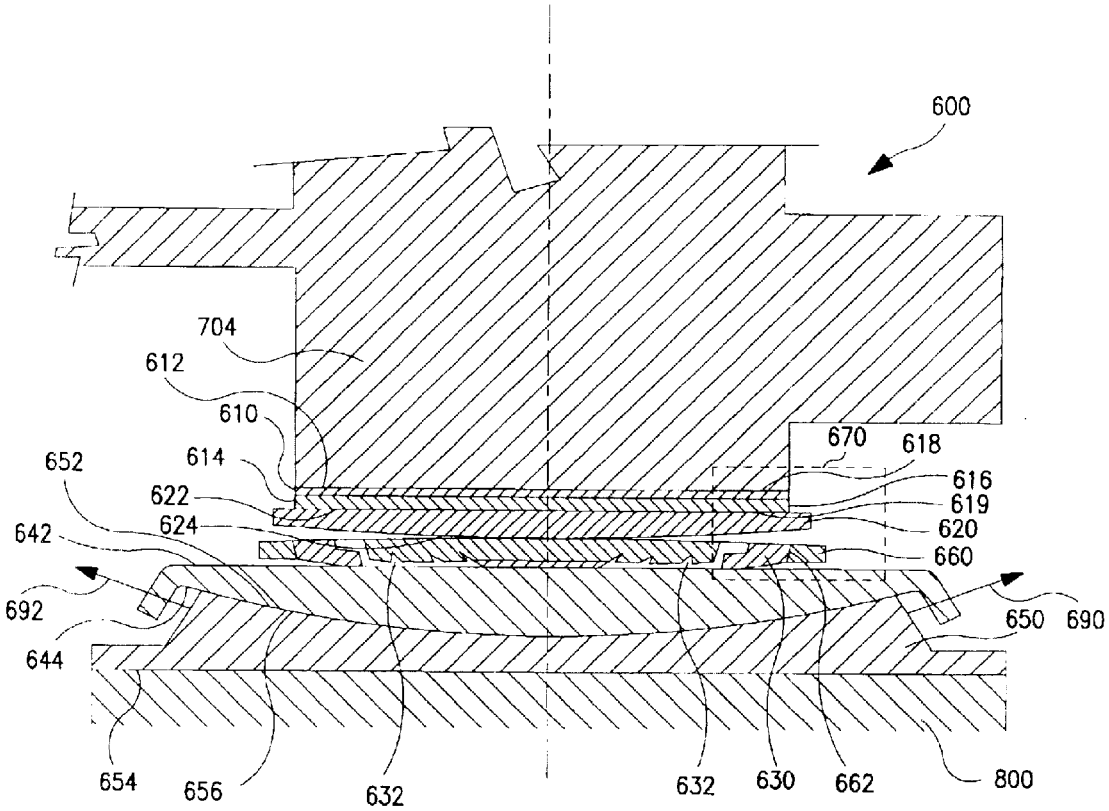
FIG. 11 is a cross-section view of the seismic filter of the Improved Aseismic System of the present invention along section line 11—11 in FIG. 2.

Referring now to FIG. 11, a cross-section of a seismic filter 600 along line 11—11 in FIG. 2 is shown. The seismic filter 600 may be installed vertically or horizontally. The seismic filters 600 which are installed to isolate the double-action hydraulic ram assemblies 200 from the foundation 800 are installed vertically between the ends of each ram 206 and the foundation 800.

The seismic filters 600 which are installed to isolate the support pillars 704 from the foundation 800 are installed horizontally between the support pillars 704 and the foundation 800. Regardless of the orientation of the seismic filter 600, the components are identical and the function is the same.

FIG. 11 shows a seismic filter 600 installed horizontally between the support pillar 704 and the foundation 800. FIG. 11 further shows a pillar support plate 610 with a flat upper surface 612 and an interior cavity 614; a jack plate 616 with a flat upper surface 618 and a flat lower surface 619; an upper seal plate 620 with a flat upper surface 622 and a flat lower surface 624; a seal 630; a seal support plate 640 with a flat upper surface 642 and a convex lower surface 644; and a main support plate 650 with a concave upper surface 652 and a flat lower surface 654.

The upper surface 612 of the pillar support plate 610 is in contact with the support pillar 704. The jack plate 616 fits into the interior cavity 614 of the pillar support plate 610. The flat lower surface 619 of the jack plate 616 is in contact with the upper surface 622 of the upper seal plate 620. The seal 630 is sandwiched between the lower surface 624 of the upper seal plate 620 and the upper surface 642 of the seal support plate 640.

The convex lower surface 644 of the seal support plate 640 fits into the concave upper surface 652 of the main support plate 650 and is separated from the concave upper surface 652 of the main support plate 650 by a lubricant 656. In a preferred embodiment this lubricant 656 may be a heavy grease, however, any lubricating material well known in the art may be used.

This curved joint allows the main support plate 650 to pivot with respect to the seal support plate 640 in all directions including, but not limited to, direction 690 and direction 692. The flat lower surface 654 of the main support plate 650 is rigidly attached to the foundation 800. During an earthquake, if the ground buckles and the foundation 800 shifts out of level, the support pillar 704 will not be affected, and it will remain vertical.

Between the upper seal plate 620 and the seal support plate 640 is a hermetically confined fluid 632 which is held in place by the seal 630. The seal 630 and the hermetically confined fluid 632 provide a frictionless surface between the upper seal plate 620 and the seal support plate 640.

In a preferred embodiment, the seal 630 is manufactured from plastic which will allow significant deformation without breaking at the point of contact of the seal 630 with the upper seal plate 620 and the seal support plate 640. Also, in a preferred embodiment, the hermetically confined fluid 632 may be oil or any other fluid with similar characteristics which will reduce the friction between the upper seal plate 620 and the seal support plate 640.

Around the seal 630 is a seal support ring 660, having an interior surface 662, which keeps the seal from bursting under the pressure of the hermetically confined fluid 632. This allows the upper seal plate 620 to move in any horizontal direction with respect to the seal support plate 640. During an earthquake, as the earth shifts back and forth, the foundation 800 may move with respect to the support pillar 704 and not cause any major damage to the structure 700.

Figure 12:
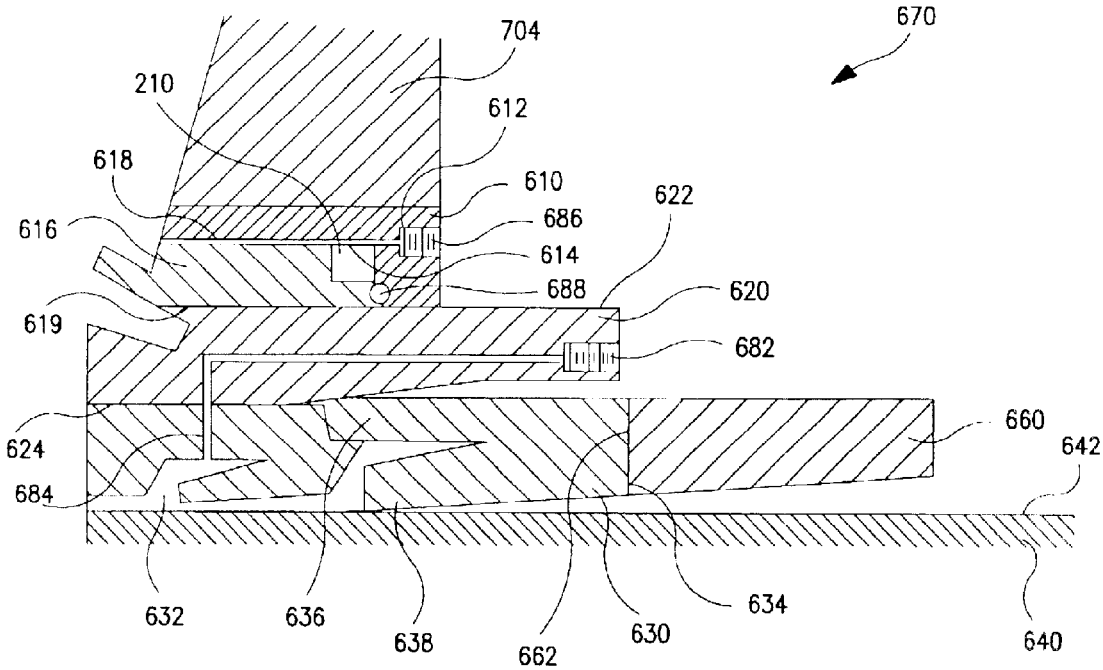
FIG. 12 is a detailed view of the cross-section of the seismic filter of the Improved Aseismic System of the present invention which is demarcated by dashed box 670 in FIG. 11.

FIG. 12 shows a detailed cross-section view of the seal 630 and how it contacts the lower surface 624 of the upper seal plate 620 and the upper surface 642 of the seal support plate 640. The upper seal plate 620 includes a seal plate valve 682 and a seal plate vein 684 which leads to the seal 630. The seal 630 may be formed with a "V" shape having a base 634 in contact with the inner surface 662 of the seal support ring 660, a first leg 636 in contact with the lower surface 624 of the upper seal plate 620, and a second leg 638 in contact with the upper surface 642 of the seal support plate 640.

At the point of contact of the first leg 636 with the upper seal plate 620 and the second leg 638 with the seal support plate 640, the seal 630 may be plastically deformed due to the pressure of the hermetically confined fluid 632 and the weight of the structure 700 above. This plastic deformation of the seal 630 serves as a barrier to keep the hermetically confined fluid 632 within the inner confines of the seal 630. In the event of leakage, fluid may be added to the hermetically confined fluid 632 through the seal plate valve 682 and the seal plate vein 684 which leads directly to the hermetically confined fluid 632.

FIG. 12 also shows the interaction between the pillar support plate 610 and the jack plate 616. The pillar support plate 610 includes a support plate valve 686 which leads directly into the interior cavity 614 of the pillar support plate 610. The pillar support plate 610 also includes an "O" ring seal 688 between the jack plate 616 and the pillar support plate 610.

As incompressible fluid 210 is pumped through the support plate valve 686 and into the interior cavity 614 of the pillar support plate 610, the fluid will fill the volume of the interior cavity 614 not displaced by the jack plate 616 and eventually lift the pillar support plate 610 from the jack plate 616. In the event that the foundation 800 beneath a support pillar 704 settles during an earthquake, this may will allow the support pillar 704 to be raised back to its original elevation.

Figure 12A:
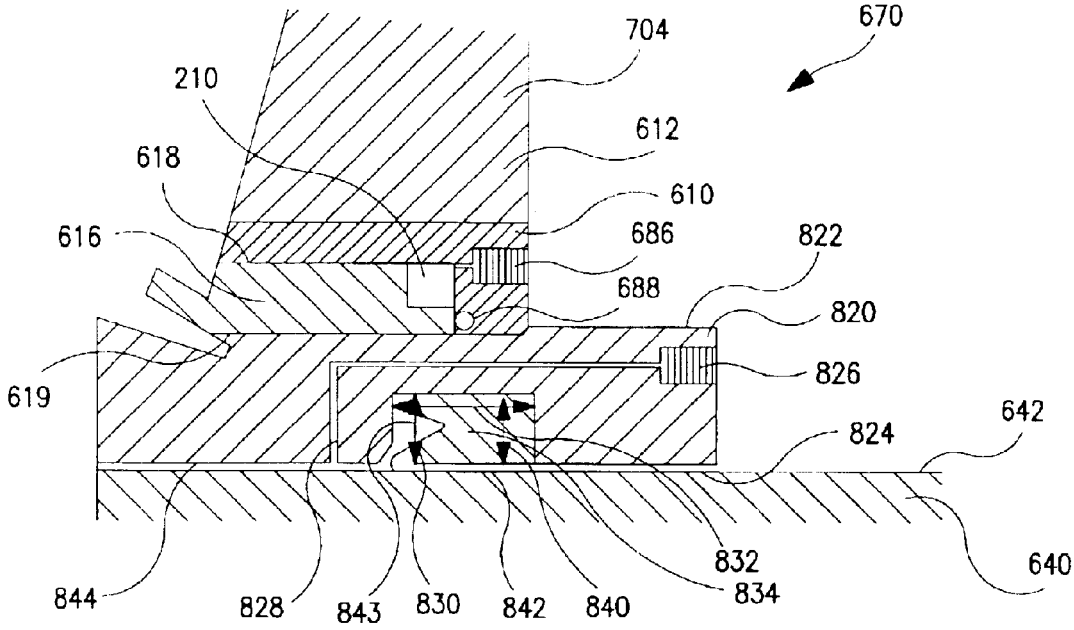
FIG. 12A is a detailed view of an alternative embodiment of the seismic filter of the Improved Aseismic System of the present invention.

Referring now to FIG. 12A, an alternative embodiment of the upper seal plate/seal configuration is shown. The upper seal plate 820 includes a flat upper surface 822, flat lower surface 824, and a seal plate valve 826. Additionally, the upper seal plate 820 may be formed with a seal plate vein 828, leading from the seal plate valve 826 to a hermetically confined fluid 844, and a continuous channel 830 having a width 832 and a height.

The seal 840 has a width 842 that may be slightly smaller than the width 832 of the channel 830 and may fit into the continuous channel 830. The seal 840 also has a height 843 which may be slightly larger than the height 834 of the continuous channel 830 to allow a portion of the seal 840 to protrude from the continuous channel 830 and separate the upper seal plate 820 from the seal support plate 640 while containing the hermetically confined fluid 844.

The continuous channel 830 may keep the seal 840 from bursting due to the pressure of the hermetically confined fluid 844 and the weight of the structure 700. It may be possible to increase the width 832 of the continuous channel 830 and install more than one seal 840 concentrically within the channel 830.

Figure 12B:
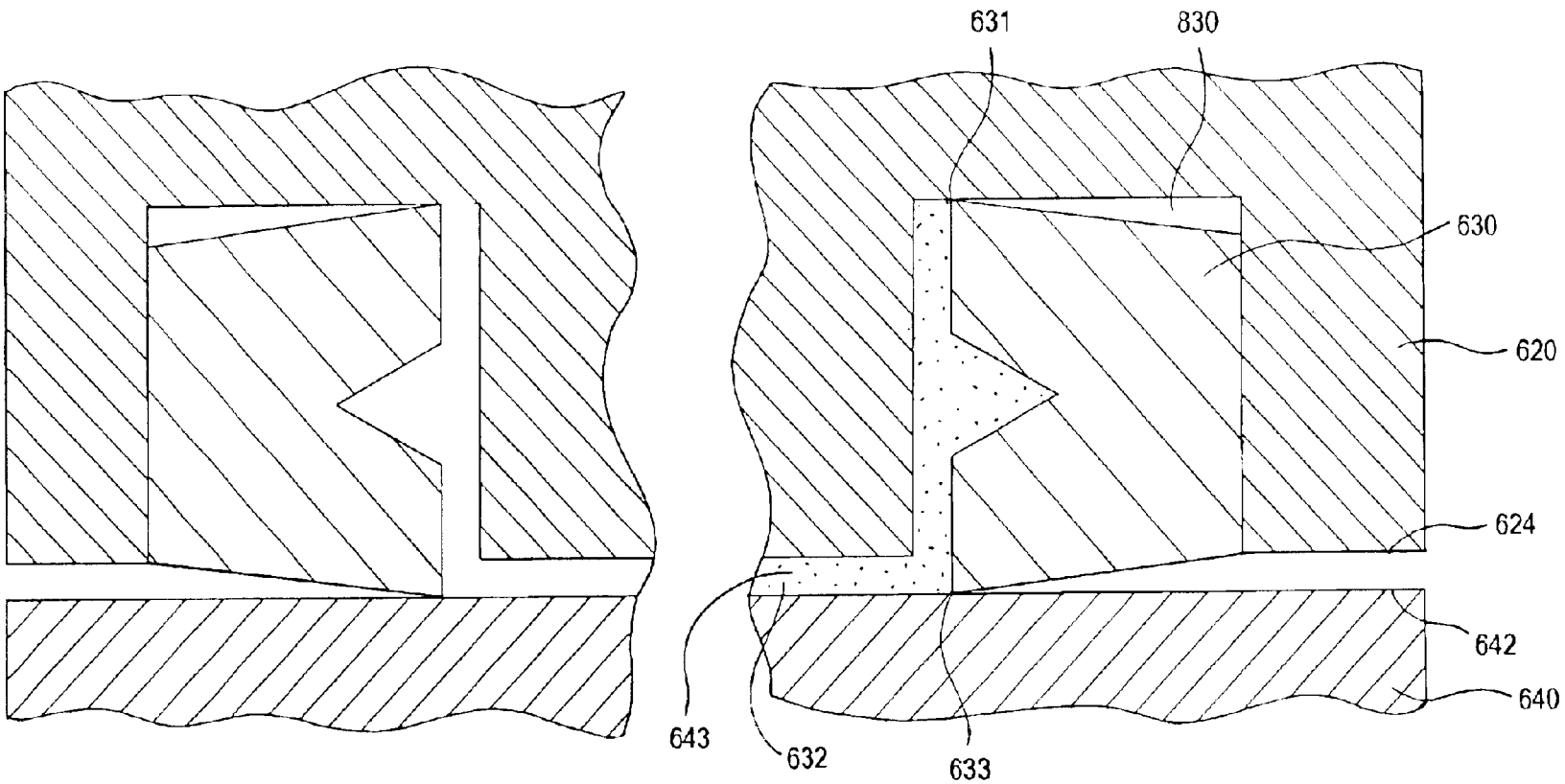
FIG. 12B is a cross-sectional view of an alternative embodiment of the seismic filter of the Improved Aseismic System of the present invention showing the circular continuous channel of the upper seal plate, and the seal being captured between the upper seal plate and the seal support plate to establish a confined fluid chamber.

Referring now to FIG. 12B, the seal 630 is shown located within the circular continuous channel 830. The first leg 636 of the seal 630 forms an upper circular point contact 631 along the lower surface 662 of the upper seal plate 620, and the second leg 638 forms a lower circular point contact 633 along the upper surface 642 of the seal support plate 640. These circular point contacts establish a seal fluid chamber 643. The hermetically confined fluid 632 occupies the seal fluid chamber 643 created by the upper seal plate 620, the seal support plate 640, and by the seal 630.

Figure 12C:
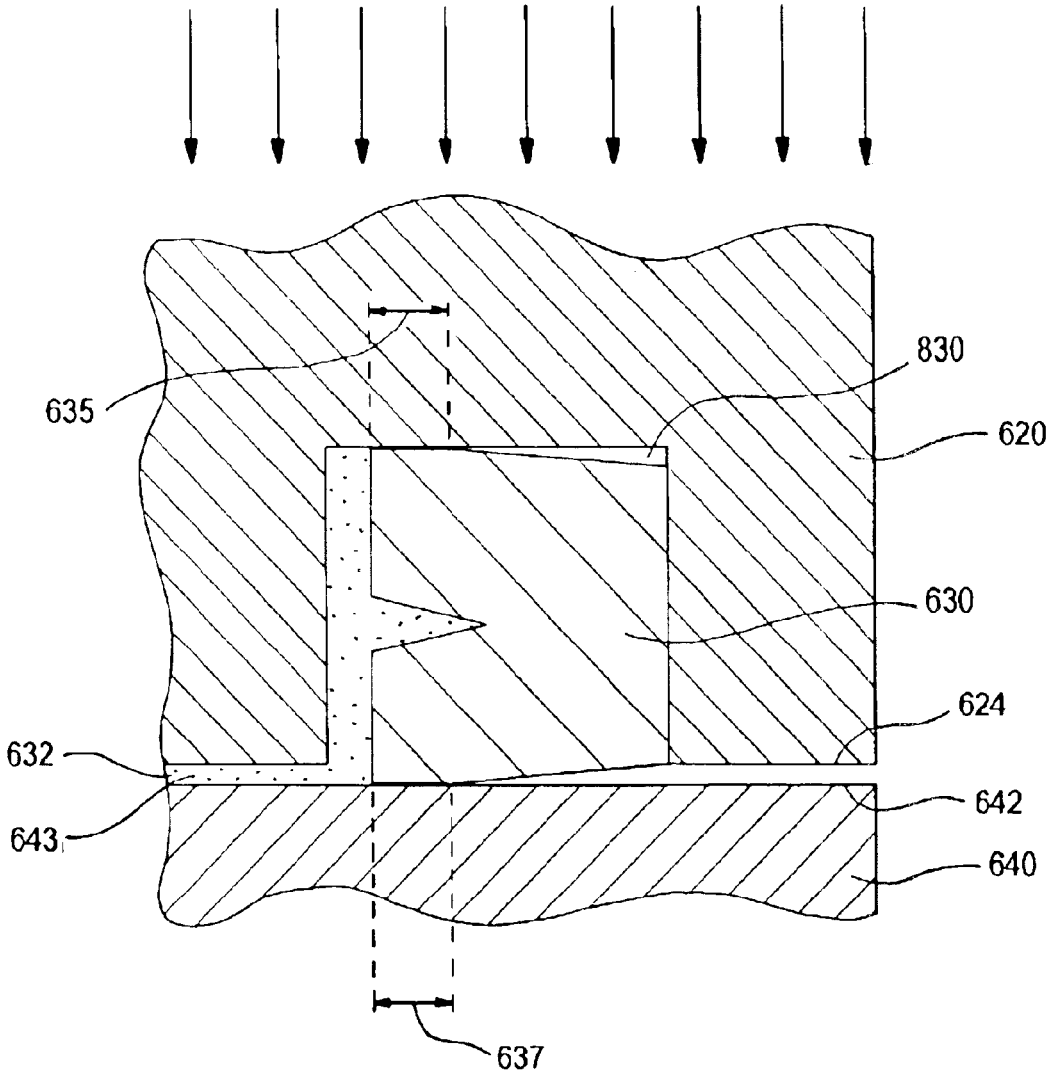
FIG. 12C is a cross-sectional view of a portion of the seal being plastically deformed between the upper seal plate and the seal support plate to provide a wider seal to maintain the fluid within the confined fluid chamber.

Additionally, the seal 630 may be self sealing, for if the hermetically confined fluid 632 loses volume, then the weight of the structure 700 acting on the upper seal plate 620 will cause the upper seal plate 620 to lower, further deforming the seal 630 at the circular point contacts by causing the upper circular point contact to flatten 635 and the lower circular point contact to flatten 637 until the leakage ceases. The seal with flattened circular point contacts is shown in FIG. 12C.

Referring now to FIGS. 13 through 16, the structure 700 is shown being acted upon by wind forces 900 and seismic forces 902. The structure includes a windward side 910, a leeward side 912, a leading side 914 and a trailing side 916.

Figure 13:
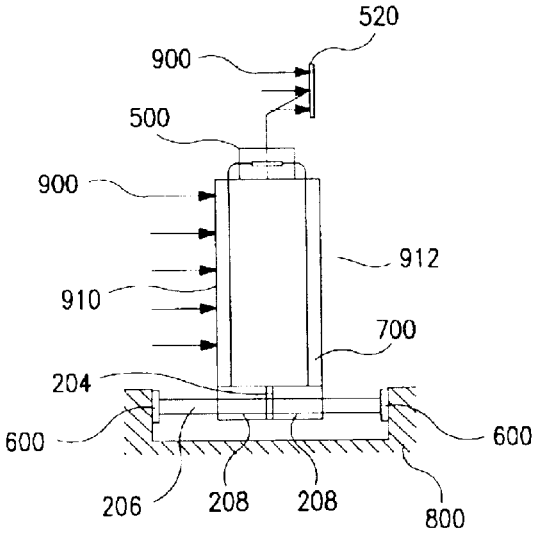
FIG. 13 is a front plan view of a structure with the Improved Aseismic System of the present invention installed showing the structure subjected to a transverse load caused by strong winds.

FIG. 13 shows the structure 700 subjected to wind forces 900 only. FIG. 13 shows the wind forces 900 acting on the windward 910 side of the structure 700. The leeward side 912 of the structure 700 is not subjected to the wind forces 900. FIG. 13 further shows the sail 522 belonging to the wind-sensitive pressure generator 500 aligned perpendicularly to the wind forces 900.

Figure 14:
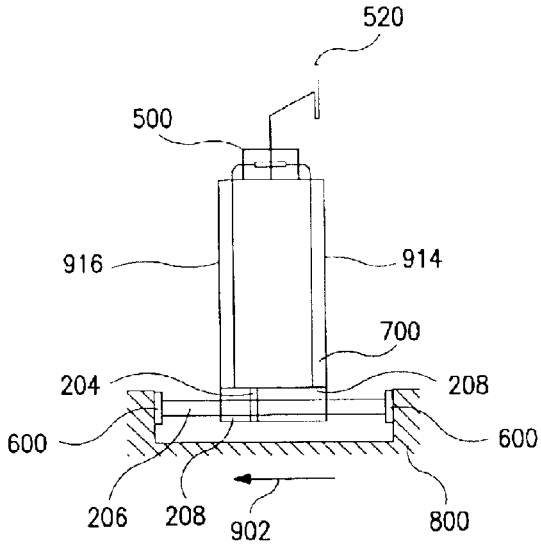
FIG. 14 is a front plan view of a structure with the Improved Aseismic System of the present invention installed showing the structure subjected to a transverse load caused by an earthquake.

FIG. 14 shows the structure 700 subjected to a seismic force 902 only. FIG. 14 shows the seismic force 902 transmitted through the foundation 800 to the ram 206. The leading side 914 of the structure 700 is the side of the structure 700 which would have initially felt the shock of the seismic force 902 if the structure 700 was rigidly affixed to the foundation 800. The trailing side 916 of the structure 700 is the other side of the structure 700.

Figure 15:
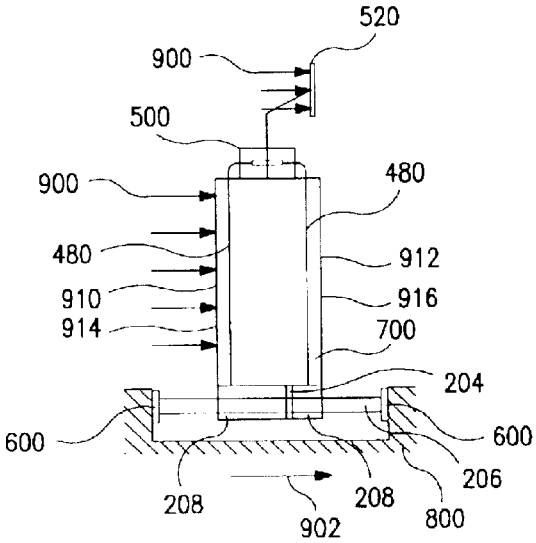
FIG. 15 is a front plan view of a structure with the Improved Aseismic System of the present invention installed showing the structure subjected to a transverse load caused by an earthquake and strong winds acting in opposite directions.

FIG. 15 shows the structure 700 subjected to wind forces 900 and a seismic force 902. FIG. 15 shows the wind forces 900 and the seismic force 902 acting in the same direction. FIG. 15 shows the windward side 910 of the structure 700 on the same side as the leading side 914 of the structure 700. FIG. 15 also shows the leeward side 912 and the trailing side 916 on the same side of the structure 700.

Figure 16:
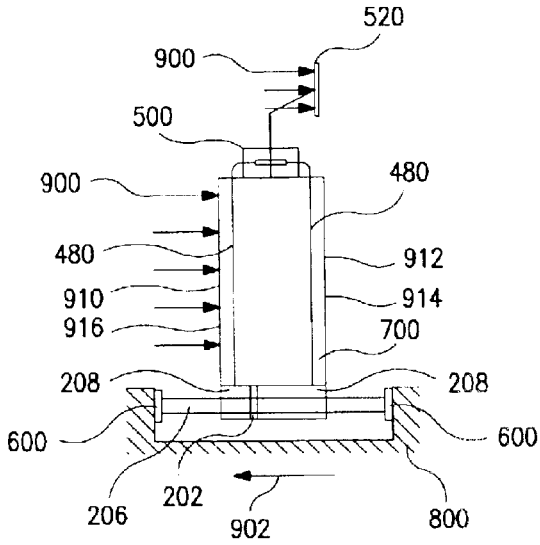
FIG. 16 is a front plan view of a structure with the Improved Aseismic System of the present invention installed showing the structure subjected to a transverse load caused by an earthquake and strong winds acting in the same direction.

FIG. 16 shows the structure 700 subjected to wind forces 900 and a seismic force 902 acting in opposite directions. As such, the windward side 910 and the leading side 914 of the structure 700 are opposite each other. The leeward side 912 and the trailing side 916 of the structure 700 are also opposite each other.

Operation of the Invention

The operation of a preferred embodiment of the present invention depends on the types of forces acting on the structure 700. There are five major components comprising the Improved Aseismic System 100 described above: the double-action hydraulic ram assemblies 200, the gas dampeners 300, the fluid flow control assemblies 400, the wind-sensitive pressure generators 500, and the seismic filters 600. These five components will react and interact differently if the structure 700 is subjected to wind forces only, seismic forces only, or wind and seismic forces combined.

The basic configuration of a preferred embodiment of the present invention includes four double-action hydraulic ram assemblies 200, eight gas dampeners 300, eight fluid flow control assemblies 400, four wind-sensitive pressure generators 500 and twelve seismic filters 600. The double-action hydraulic ram assemblies 200 are arranged in a square in the basement 708 of the structure 700, but depending on the shape of the structure 700, the double-action hydraulic ram assemblies 200 may be arranged in other patterns.

Each double-action hydraulic ram assembly 200 is attached to two gas dampeners 300, two fluid flow control assemblies 400, one wind-sensitive pressure generator 500 and two seismic filters 600. Each support pillar 704 may be mounted on a seismic filter 600. In the present configuration of the present invention, there are four support pillars 704.

Regardless of the forces that the structure 700 is subjected to, the seismic filters 600 will perform the same function. The seismic filters 600, installed beneath the support pillars 704, provide a stable frictionless base for the structure 700. If the structure 700 is subjected to a force in any direction, the upper seal plate 620 of each seismic filter 600 installed beneath the support pillars 704 may move in any direction along the corresponding seal support plate 640 and isolate the support pillars 704 from the foundation 800. This will effectively eliminate the transmission of destructive forces from the foundation 800 to the support pillars 704.

The seismic filters 600, attached to the double-action hydraulic ram assemblies 200, may also effectively isolate the rams 206 from destructive forces transmitted by the foundation 800. As the structure 700 moves longitudinally along a pair of double-action hydraulic ram assemblies 200, the seismic filters 600 attached to the ends of the rams 206 will allow the same double-action hydraulic ram assemblies 200 to move laterally. The upper seal plates 620 of each seismic filter 600, installed between the ram 206 and the foundation 800, will move along the corresponding seal support plates 640. This will allow the rams 206 to move laterally as the structure 700 moves longitudinally along the rams 206.

Reaction of the Improved Aseismic System to Wind Forces Only

When the structure 700 is subjected to wind forces 900 only, as shown in FIG. 13, the Improved Aseismic System 100 will react accordingly and keep the structure 700 from moving along the double-action hydraulic ram assemblies 200. As the wind blows across the structure 700, the sail 522 belonging to the wind-sensitive pressure generator 500 will rotate about the spherical socket 506 and align itself perpendicular to the direction of the wind forces 900.

As the wind blows, it will cause the sail 522 to dip downward and pivot along arc 550 toward the leeward side 912. The motion of the sail 522 will cause the plunger actuator 530 to move in toward the windward side 910 and depress the plunger 532 on the windward side 910 of the structure 700. The motion of the plunger 532 will force the incompressible fluid 210 to move within the sealed pipe 480 on the windward side 910 of the structure 700 and inject incompressible fluid 210 into the lower fluid chamber 470 of the fluid flow control assembly 400.

The injection of incompressible fluid 210 into the lower fluid chamber 470 will cause the lower piston 460 to travel upward along axis 498, which will in turn force the incompressible fluid 210 upward. This will force the lower valve 421 into the closed position as shown in FIG. 6. With the lower valve 421 closed the incompressible fluid 210 cannot move from the hydraulic ram fluid chamber 208 into its corresponding gas dampener 300.

The structure 700 will not be able to move in the direction of the leeward side 912 if the flow of incompressible fluid 210 from the fluid chambers 208 on the windward side 914 of the double-action hydraulic ram assemblies 200 is blocked.

If the wind subsides, each component will return its equilibrium state. The lower valve 421 in the fluid flow control assembly 400 will open allowing the free flow of incompressible fluid 210 between the double-action hydraulic ram assembly 200 and the gas dampener 300.

Reaction of the Improved Aseismic System to Seismic Forces Only

When the structure 700 is subjected to a seismic force 902 only, as shown in FIG. 14, the Improved Aseismic System 100 will react accordingly and isolate the structure 700 from these transverse forces. As the foundation 800 shifts due to the seismic force 902, the two double-action hydraulic ram assemblies 200 that are aligned with the motion of the foundation 800 will allow the foundation 800 to move with respect to the base 702 of the structure 700. The rams 206 will shift within the cylindrical housings 202 forcing the pistons 204 to push the incompressible fluid 210 out of the fluid chambers 208 on the trailing side 916 and into the fluid chambers 370 of the corresponding gas dampeners 300.

The gas dampener 300 will act as a shock absorber and, depending on the strength of the seismic force 902, the gas dampener 300 will provide the appropriate resistance. A small tremor resulting in little motion of the ram 206 with respect to the cylindrical ram housing 202 will force less incompressible fluid 210 into the gas dampener fluid chamber 370 than a large tremor causing greater motion of the ram 206 with respect to the cylindrical ram housing 202. Initially, the incompressible fluid 210, which flows into the gas dampener fluid chamber 370, will force the first piston 310 to travel upward along axis 380 and compress the first gas 330.

If the tremor ceases, the first gas 330 will return to its starting pressure and return the first piston 312 to its static position which will force the incompressible fluid 210 back into the hydraulic ram fluid chamber 208 in the cylindrical ram housing 202 of the double-action hydraulic ram assembly 200 and return the structure to the equilibrium position centered on the ram 206.

If the tremor continues or the seismic force 902 is stronger, the first piston 310 will continue to move upward along axis 380 until the pressure in the first gas 330 is equal to the pressure of the second gas 332. When the pressure of the first gas 330 is equal to pressure of the second gas 332, the first piston 310 and the second piston 312 will move upward, in unison, along axis 380.

The upward motion of the first piston 310 and the second piston 312 will continue to compress the first gas 330 and begin compressing the second gas 332 at the same pressure as the first gas 330. If the tremor ceases, the second gas 332 and the first gas 330 will return to their respective starting pressures and return the second piston 312 and the first piston 310 to the static position which will force the incompressible fluid 210 back into the hydraulic ram fluid chamber 208 in the cylindrical ram housing 202 of the double-action hydraulic ram assembly 200 and return the structure 700 to the equilibrium position centered on the ram 206.

If the tremor continues or the seismic force 902 becomes even stronger, the first piston 310 and the second piston 312 will continue to move upward along axis 380 until the pressures of the first gas 330 and the second gas 332 are equal to the pressure of the third gas 334. Once the pressures of all three gases are equal, the first piston 310, the second piston 312 and the third piston 314 will travel upward in unison along axis 380. This motion will continue to compress the first gas 330 and the second gas 332 and begin compressing the third gas 334 and the fourth gas 336 at the same rate.

Again, if the tremor ceases, the third gas 334, the second gas 332, and the first gas 330 will return to their respective starting pressures and return the third piston 314, the second piston 312 and first piston 310 to their static positions which will force the incompressible fluid back into the hydraulic ram fluid chamber 208 in the cylindrical ram housing 202 of the double-action hydraulic ram assembly 200 and return the structure 700 to the equilibrium position centered on the ram 206.

If the tremor continues or the seismic force 902 continues to grow in strength, the first piston 310, the second piston 312, and the third piston 314 will continue to move upward along axis 380 until the spring loaded stem assembly 350 closes the gas valve 340. Closing the gas valve 340 significantly decreases the volume that the third gas 334 occupies, and, as such, the pressures in gases 330, 332 and 334 will rapidly rise with the continued increase in the force of the tremor. The pressure in the fourth gas 336 will remain constant once the gas valve 340 is closed.

If the tremor ceases, the fourth gas 336, the third gas 334, the second gas 332, and the first gas 330 will return to their respective starting pressures and return the third piston 314, the second piston 312 and first piston 310 to their static positions which will force the incompressible fluid 210 back into the hydraulic ram fluid chamber 208 in the cylindrical ram housing 202 of the double-action hydraulic ram assembly 200 and return the structure 700 to the equilibrium position centered on the ram 206.

If the tremor continues or the seismic force 902 again increases in strength, the first piston 310, the second piston 312, and the third piston 314 will continue to move upward along axis 380 and the pressure in the first gas 330, the second gas 332 and the third gas 334 will increase sharply and act as a cushion keeping the cylindrical ram housing 202 from impacting the seismic filter 600 attached to the end of the ram. If the tremor ceases, the gas dampener 300 will return to the static position and return the structure 700 to the static position centered along the ram 206.

As the structure 700 moves with respect to the foundation 800 along two of the double-action hydraulic ram assemblies 200, the other two double-action hydraulic ram assemblies 200 will move with respect to the foundation 800 at the seismic filters 600. Moreover, the configuration of the Improved Aseismic System 100 of the present invention allows for lateral motion of the double-action hydraulic ram assemblies 200 as the structure 700 moves longitudinally along the rams 206. The seismic filters 600, attached to the ends of the rams 206, isolate the rams 206 from the foundation 800 and allow lateral motion of the rams 206 with respect to the foundation 800.

It is to be appreciated that earthquake tremors are not typically unidirectional. As such, the gas dampeners 300 located on each side of the double-action hydraulic ram assemblies 200 act in tandem to absorb the oscillating forces caused by the seismic activity. The operation described above is simply the operation of the Improved Aseismic System 100 of the present invention during one theoretical cycle of the oscillating tremor.

As the tremor oscillates, the force will come from the opposite direction. The hydraulic ram fluid chamber 208 and the gas dampener 300 opposite those described above will then take the brunt of the earthquake's force and react to absorb that force and cushion the structure 700 from any impact by the foundation 800 or seismic filters 600.

It is also to be appreciated that in most cases the seismic forces 902 will not be transmitted in a direction directly in line with a single pair of the double-action ram assemblies 200. In most cases, the seismic force 902 will impact the foundation 800 at an angle with the double-action hydraulic ram assemblies 200. It can be shown, through the use of vector mathematics, that the component parts of the seismic forces 902 may be transmitted along all of the rams 206 at the same time. It can then be appreciated that it is possible that the structure may move with respect to the foundation 800 along all four of the double-action hydraulic ram assemblies 200 at the same time while the rams 206 also move with respect to the foundation 800.

Reaction of The Improved Aseismic System to Wind Forces and Seismic Forces

When the structure 700 is subjected to wind forces 900 and seismic forces 902, the reaction of the Improved Aseismic System 100 of the present invention will depend on whether these forces 900 and 902 are acting in the same direction or in opposing directions. If the wind is blowing constantly in one direction, the combination of the wind force 900 and the seismic force 902 will vary with the oscillation of the seismic forces 902.

When the direction of the wind force 900 coincides with the direction of the seismic force 902, the Improved Aseismic System 100 will react accordingly.

Initially, the fluid flow control assembly 400 on the leeward side 912 of the structure 700 will be in the open position as shown in FIG. 5. The fluid flow control assembly 400 on the windward side 910 of the structure 700 will react as described previously and the lower valve 421 will close and block the flow of incompressible fluid 210 through the upper fluid chamber 402 of the fluid flow control assembly 400 between the double-action hydraulic ram assembly 200 and the gas dampener 300. This will provide the initial resistance to the wind forces 900.

However, the seismic force 902 acting in the same direction as the wind forces 900 will cause the foundation 800 to move toward the leeward side 912. As the foundation moves 800 the ram 206 will also move toward the leeward side 912 causing the volume of the hydraulic ram fluid chamber 208 on the windward side 910 of the double-action hydraulic ram assembly 200 to increase.

The increase in volume will cause a pressure drop in the hydraulic ram fluid chamber 208 on the windward side 910 and the upper valve 411 will be open, as shown in FIG. 7, allowing the incompressible fluid 210 to flow from the gas dampener 300 on the windward side 910 of the double-action hydraulic ram assembly 200 to the corresponding hydraulic ram fluid chamber 208 also on the windward side 910.

This will allow the foundation 800 to move with respect to the structure 700 along the rams 206 and isolate the structure 700 from the seismic force 902. The gas dampeners 300 on the trailing side 914 of the structure 700 will function as described above and absorb the tremor and keep the base 702 of the structure 700 from impacting the foundation 800.

When the direction of the wind force 900 is opposite the direction of the seismic force 902 the Improved Aseismic System 100 will react accordingly. Initially, the fluid flow control assembly 400 on the leeward side 912 of the structure 700 will be in the open position as shown in FIG. 5. The fluid flow control assembly 400 on the windward side 910 of the structure 700 will react as described previously and the lower valve 421 will close and block the flow of incompressible fluid 210 through the upper fluid chamber 402 of the fluid flow control assembly 400 between the double-action hydraulic ram assembly 200 and the gas dampener 300 on the windward side 910. This will provide the initial resistance to the wind forces.

However, if the seismic force 902 acting opposite the wind forces 900 creates a pressure in the incompressible fluid 210 with a resultant force on the valve cap 423 that is greater than the force transmitted to the lower pressure surface 424 by incompressible fluid 210, the lower valve 421 will open, as shown in FIG. 8, and allow the flow of incompressible fluid 410 between the double-action hydraulic ram assembly 200 and the gas dampener 300 on the windward side 910.

This will allow the double-action hydraulic ram assembly 200 to overcome the initial resistance to the wind forces and the foundation will move in toward the windward side 910 to isolate the base 702 of the structure 700 from the seismic forces transmitted by the foundation 800. The gas dampeners 300 on the windward side 902 of the structure 700 will function as described above and absorb the tremor and keep the base 702 of the structure 700 from impacting the foundation 800.

While the Improved Aseismic System 100 of the present invention as herein shown and disclosed in detail is fully capable of obtaining the objects and providing the advantages herein before stated, it is to be understood that it is merely illustrative of a preferred embodiment of the invention and that no limitations are intended to the details of construction or design herein shown other than as described in the appended claims.

I claim:

1. An upper seal plate and seal assembly on an aseismic system comprising:

a flat upper surface that supports a pillar of a building having a foundation;

a flat lower surface;

a seal plate valve located between said flat upper surface and said flat lower surface; and at least one seal located in a cutout at a bottom portion of said flat lower surface, and wherein said flat upper surface can shift its position relative to said flat lower surface and the foundation.

2. The upper seal plate and seal assembly on an aseismic system in claim 1 further comprising a seal plate vein that creates a gap between said flat upper surface and said flat lower surface.

3. The upper seal plate and seal assembly on an aseismic system in claim 2 further comprising hermetically confined fluid located within said seal plate vein.

4. A seismic filter in combination with a structure comprising:

an upper seal plate having a lower surface, and supporting said structure;

a seal support plate having an upper surface;

a seal having a first leg, a second leg and a base, wherein said lower surface of said upper seal plate contacts said first leg and said upper surface of said seal support plate contacts said second leg, forming a chamber located between said lower surface of said upper seal plate, said upper surface of said seal support plate, and said seal;

a hermetically confined fluid, wherein said hermetically confined fluid is contained in said chamber; and a means for pressurizing said seismic filter with said hermetically confined fluid.

5. The seismic filter of claim 4 wherein said first leg of said seal and said second leg of said seal form a "V" shape with said base of said seal.

6. The seismic filter of claim 5 wherein said first leg of said seal forms a top circular point contact with said lower surface of said upper seal plate and said second leg of said seal forms a bottom circular point contact with said upper surface of said support plate.

7. The seismic filter of claim 6 wherein said first leg of said seal plastically deforms such that the weight of said structure over said upper seal plate and the pressure of said hermetically confined fluid within said chamber flattens said top circular point contact, to seal said hermetically confined fluid within said chamber.

8. The seismic filter of claim 7 wherein said second leg of said seal plastically deforms such that the weight of said structure over said upper seal plate and the pressure of said hermetically confined fluid within said chamber flattens said bottom circular point contact, to seal said hermetically confined fluid within said chamber.

9. The seismic filter of claim 8 wherein said first leg and said second leg of said seal plastically deforms such that the weight of said structure over said upper seal plate and the pressure of said hermetically confined fluid within said chamber flattens both said top circular point contact and said bottom circular point contact, to seal said hermetically confined fluid within said chamber.

10. The seismic filter of claim 4 wherein said means for pressurizing said seismic filter comprises a seal plate valve and a seal plate vein, wherein said seal plate valve is located on said upper seal plate and allows fluid to be added through said seal plate vein to said chamber containing said hermetically confined fluid.

11. The seismic filter of claim 4 further comprising a seal support ring placed around said seal, said seal support ring having an inner surface contacting said base of said seal.

* * * * *